US009751691B2

(12) United States Patent
Hunter

(10) Patent No.: US 9,751,691 B2
(45) Date of Patent: Sep. 5, 2017

(54) SILOSACK CONTAINER

(71) Applicant: COMPOSITE CONTAINERS LLC, Wando, SC (US)

(72) Inventor: Andrew Hunter, Mt. Pleasant, SC (US)

(73) Assignee: COMPOSITE CONTAINERS, Wando, SC (US)

( * ) Notice: Subject to any disclaimer, the term of this patent is extended or adjusted under 35 U.S.C. 154(b) by 316 days.

(21) Appl. No.: 14/356,986

(22) PCT Filed: Nov. 2, 2012

(86) PCT No.: PCT/US2012/063275

§ 371 (c)(1),
(2) Date: May 8, 2014

(87) PCT Pub. No.: WO2013/070516

PCT Pub. Date: May 16, 2013

(65) Prior Publication Data

US 2015/0203288 A1 Jul. 23, 2015

Related U.S. Application Data

(60) Provisional application No. 61/557,298, filed on Nov. 8, 2011.

(51) Int. Cl.
*B65D 90/20* (2006.01)
*B65D 88/16* (2006.01)
(Continued)

(52) U.S. Cl.
CPC ..... *B65D 90/205* (2013.01); *B65D 88/1668* (2013.01); *B65D 88/1681* (2013.01);
(Continued)

(58) Field of Classification Search
CPC ..... B65D 90/205; B65D 88/28; B65D 90/08; B65D 88/1681; B65D 88/1668; B65D 2588/165; D05B 13/00; Y10T 29/49826
(Continued)

(56) References Cited

U.S. PATENT DOCUMENTS 2,720,998 A * 10/1955 Potter ..... B65D 19/12 220/6
3,433,400 A * 3/1969 Hawkins ..... B65D 5/2033 222/183
(Continued)

FOREIGN PATENT DOCUMENTS

| | | | |
|---|---|---|---|
| EP | 1375387 | A1 | 1/2004 |
| JP | 2002160795 | A | 6/2002 |
| WO | 9529851 | A1 | 11/1995 |

OTHER PUBLICATIONS

International Search Report, Mar. 18, 2013.
International Preliminary Report on Patentability, Nov. 8, 2011.

*Primary Examiner* — Donnell Long
(74) *Attorney, Agent, or Firm* — Tristan A. Fuierer; Moore & Van Allen, PLLC

(57) ABSTRACT

A collapsible container, a method of manufacturing, and a method of using the same is provided herein. In some embodiments, the collapsible container is octagonal, generally square, or generally rectangular while comprising eight side panels have receiving pockets for receiving stiffening panels. The collapsible container may include a third layer sewn to the inside of the walls such that content loaded into the third layer is directed to a spout at the bottom of the third layer for convenient discharge of contents. The eight side panels are designed such that the container can be collapsed for easy transport but also stably supports and facilitates discharge of contents from the third layer when the container is set up.

18 Claims, 23 Drawing Sheets

(51) Int. Cl.
*B65D 90/08* (2006.01)
*B65D 88/28* (2006.01)
*D05B 13/00* (2006.01)

(52) U.S. Cl.
CPC ..... *B65D 88/28* (2013.01); *B65D 90/08* (2013.01); *D05B 13/00* (2013.01); *B65D 2588/165* (2013.01); *Y10T 29/49826* (2015.01)

(58) Field of Classification Search
USPC ..... 222/1, 105, 131, 185.1, 183, 181.2; 29/428; 112/475.08; 220/9.4
See application file for complete search history.

(56) References Cited

U.S. PATENT DOCUMENTS 3,815,772 A * 6/1974 Elmore ..... F16L 55/07 217/3 BC
3,961,655 A * 6/1976 Nattrass ..... B65D 88/1618 222/181.3
4,143,796 A * 3/1979 Williamson ..... B65D 88/1612 222/181.3
4,903,859 A 2/1990 Derby et al.
5,158,369 A 10/1992 Derby
5,230,689 A 7/1993 Derby
5,333,757 A * 8/1994 Volk ..... B65G 65/44 222/105
5,713,510 A * 2/1998 Walton ..... B65D 25/22 220/754
5,934,474 A 8/1999 Renninger et al.
6,196,719 B1 3/2001 Brown
6,203,198 B1 3/2001 Stone et al.
6,220,755 B1 4/2001 Brown et al.
6,224,260 B1 5/2001 Nickell et al.
6,224,261 B1 5/2001 Stone
6,244,443 B1 6/2001 Nickell et al.
6,299,354 B2 10/2001 Nickell et al.
6,415,927 B1 7/2002 Stone et al.
6,575,629 B1 * 6/2003 Perkins ..... B65D 77/061 220/9.4
6,688,471 B2 2/2004 Stone et al.
6,739,753 B2 5/2004 Richardson et al.
6,935,508 B2 8/2005 Stone et al.
6,968,946 B2 11/2005 Shuert
7,018,098 B2 3/2006 Ricahrdson et al.
2010/0065466 A1 * 3/2010 Perkins ..... B65D 19/385 206/600
2014/0086512 A1 3/2014 Brown et al.
2014/0198999 A1 7/2014 Brown et al.

* cited by examiner

Section A-A

SILOSACK CONTAINER

CROSS-REFERENCE TO RELATED APPLICATIONS

This application is filed under the provisions of 35 U.S.C. §371 and claims the priority of International Patent Application No. PCT/US2012/063275 filed on 2 Nov. 2012 entitled "SILOSACK CONTAINER" in the name of Andrew HUNTER, which claims priority to U.S. Provisional Patent Application No. 61/557,298 filed on 8 Nov. 2011, all of which are hereby incorporated by reference herein in their entirety.

TECHNICAL FIELD

This invention relates generally to collapsible containers, and more particularly to a collapsible container for receiving, storing, transporting, and discharging products.

BACKGROUND

Historically, cardboard, wood, or synthetic containers have been used for receiving, storing, transporting, and discharging products of all types. These containers are typically constructed in square, rectangular, or circular shapes with lift straps attached to each of the uppermost corners of the container.

Alternatively, flexible intermediate bulk containers (FIBC) or bulk bags are used. The bulk bags, however, are not stable so they only stack two high. To lift the bulk bags, a fork lift must be maneuvered so that the tines of the fork lift pass through four fabric loops located on the four corners of the bag. Because most users work alone to load the bulk bags, this is a very unsafe and time consuming process. The bag is only supported by the four loops and hence it is dangerous and against OSHA regulations to go underneath a suspended bag.

Re-usable plastic containers are also used to transport content. These containers are heavy, costly to manufacture, and do not collapse for convenient transport. Because of the height of the containers, they can only be stacked two high in standard trucks resulting in increased return shipping charges.

Standard boxes, bulk bags, and re-usable plastic containers are difficult to completely empty. Materials stored in the containers may be caught in the corners of the container and to completely empty the user may need to reach inside or somehow dislodge the material from the containers. This causes excess time and cost in emptying the containers and may result in contaminated containers from either leftover materials or the user reaching into the containers to remove the material.

Thus, there is a need for a strong collapsible container that can automatically and completely discharge content and then be collapsed for convenient transport.

SUMMARY

Embodiments of the present invention provide a collapsible container for use in storing materials. In an embodiment, the container includes a collapsible sleeve having a first end and a second end; and a liner attached to the collapsible sleeve at the first end, wherein the liner is suspended through the collapsible sleeve and includes an apex between the first end and the second end. In a further embodiment, the apex includes an opening configured for discharging content from the collapsible container. In a still further embodiment, the first end and the second end is open. In some embodiments, a cylinder extends from the apex to a position on the opposite side of the second end. A sealing mechanism may close the apex. For example, the sealing mechanism may be selected from the group consisting of rope, twist ties, Velcro, cable ties, and clips.

In some embodiments, a rigid lid attached at the first end of the sleeve and configured to support the weight of a second container. In an embodiment, the collapsible sleeve comprises eight receiving pockets configured for receiving eight stiffening panels. The eight receiving pockets may be defined by vertical seams. In further embodiments, a horizontal reinforcement band is positioned on the periphery of the collapsible sleeve and configured to prevent the collapsible sleeve from expanding beyond a predetermined amount. In some embodiments, lift loops are attached to the collapsible container and configured for lifting the collapsible container when contents are loaded into the liner. The liner may be configured to have a continuous negative slope from the first end to the apex when the container is lifted using the lift loops. In some embodiments, the collapsible sleeve is defined by four angles of approximately 90 degrees and four angles of approximately 180 degrees. In a further embodiment, the wall panels defined by the eight angles are equal in length and width.

In another aspect, a method for manufacturing a collapsible container is provided. In an embodiment, the method includes providing four side wall assemblies each comprising an inner layer and an outer layer of fabric; securing two of the side wall assemblies together using a sew line; securing the four side wall assemblies together end to end, alternating the side wall assemblies with the sew line and the side wall assemblies without the sew line to create a collapsible sleeve having a first end and a second end; and providing rigid panels for pockets defined by the sew lines and the ends of the four side assemblies. The method may also include providing a liner attached to the collapsible sleeve at the first end, wherein the liner is suspended through the sleeve and includes an apex between the first end and the second end.

In a further aspect, another method for manufacturing a collapsible container is provided. In an embodiment, the method includes providing four side wall assemblies, wherein two of the four side wall assemblies are a single layer and two of the four side wall assemblies are a double layer; securing the four side wall assemblies together end to end, alternating the side wall assemblies with a single layer and the side wall assemblies with a double layer to create a collapsible sleeve having a first end and a second end; providing a vertical sew line in each of the double layer wall assemblies, the vertical sew lines defining two pockets in each of the double layer wall assemblies; providing two swing walls attached to opposing vertical seams between the single layer wall and the double layer wall such that one of the swing walls may be positioned substantially adjacent to the single layer wall; and providing rigid panels for the pockets. The method may also include providing a liner attached to the collapsible sleeve at the first end, wherein the liner is suspended through the sleeve and includes an apex between the first end and the second end.

In a still further aspect, a method for discharging content from a collapsible container is provided. In an embodiment, the method includes providing a container as disclosed herein; loading content into the container when the container is in a free-standing configuration; and discharging the content through the apex. The method may also include releasing a sealing mechanism at the apex to open the liner and discharge the content.

The features, functions, and advantages that have been discussed may be achieved independently in various embodiments of the present invention or may be combined with yet other embodiments, further details of which can be seen with reference to the following description and drawings.

BRIEF DESCRIPTION OF THE DRAWINGS

Figure 1:
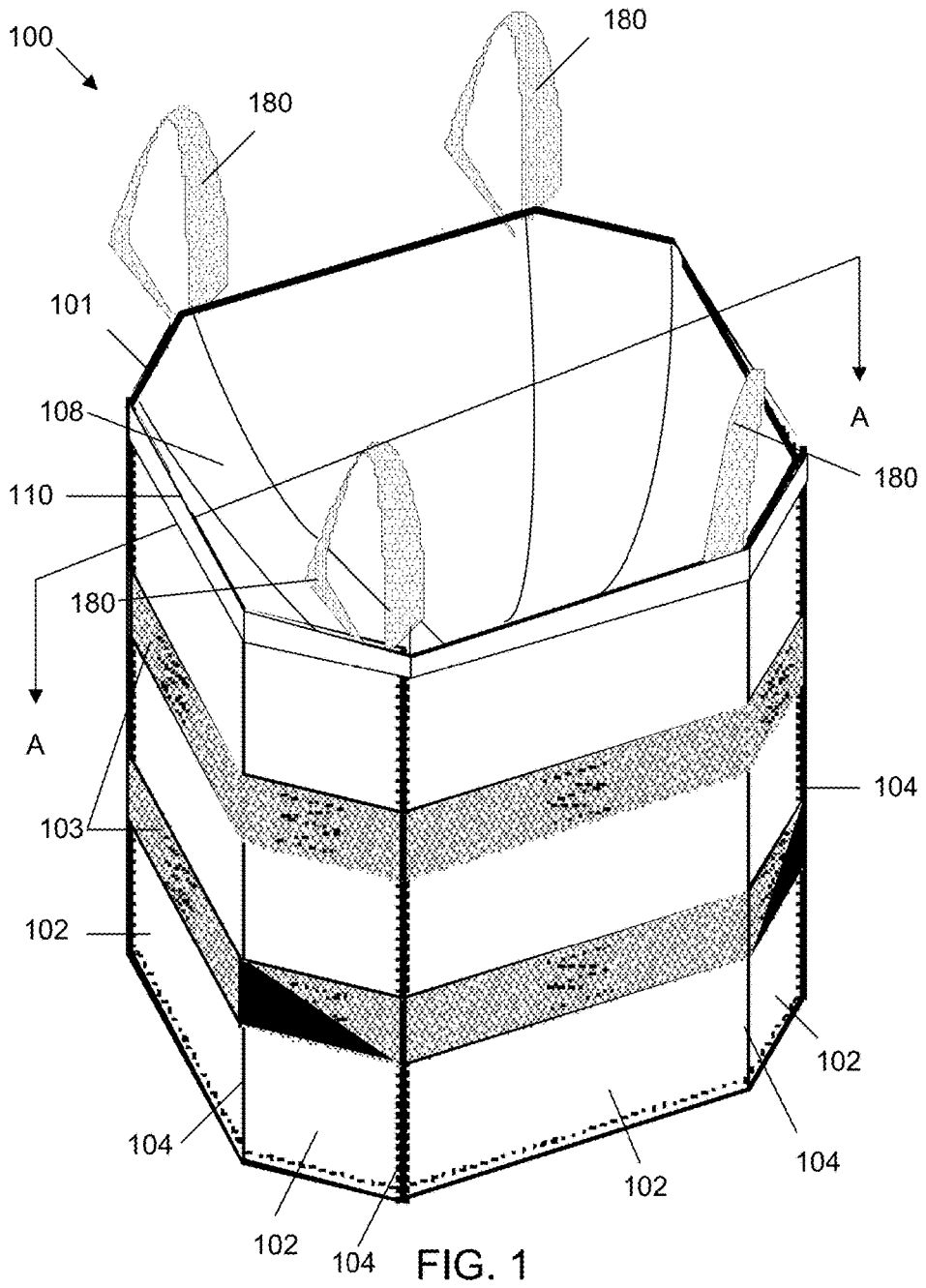

Having thus described embodiments of the invention in general terms, reference will now be made the accompanying drawings, wherein:

FIG. 1 shows a perspective view of a collapsible container in one aspect of the present invention.

Figure 2:
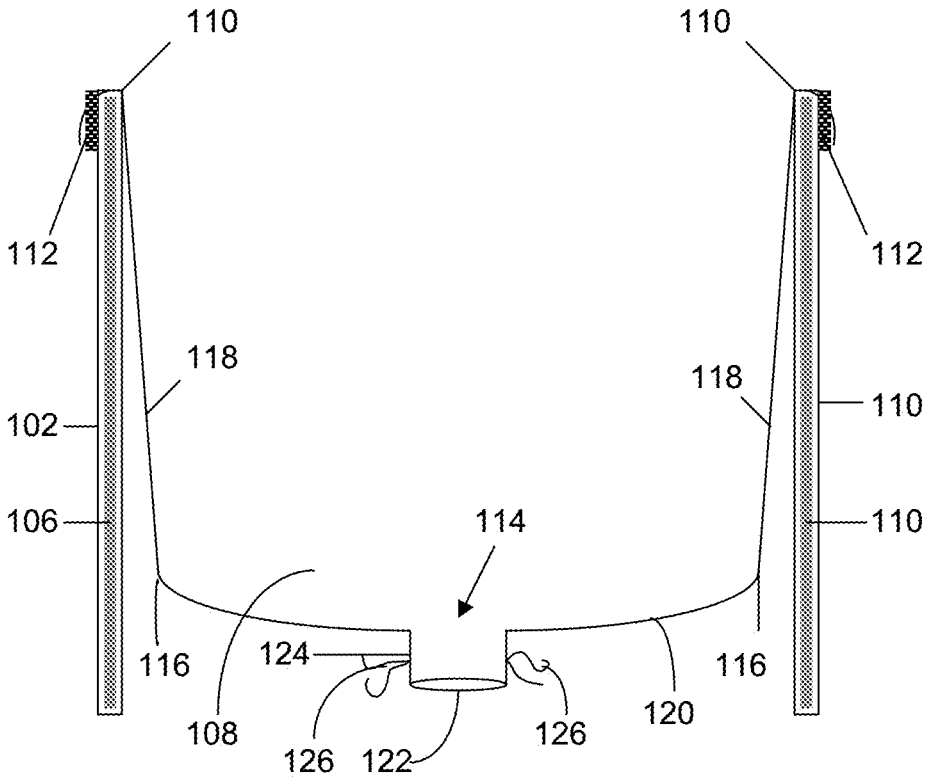

FIG. 2 shows a section view of the collapsible container of FIG. 1 at line A-A according to one embodiment.

Figure 3:
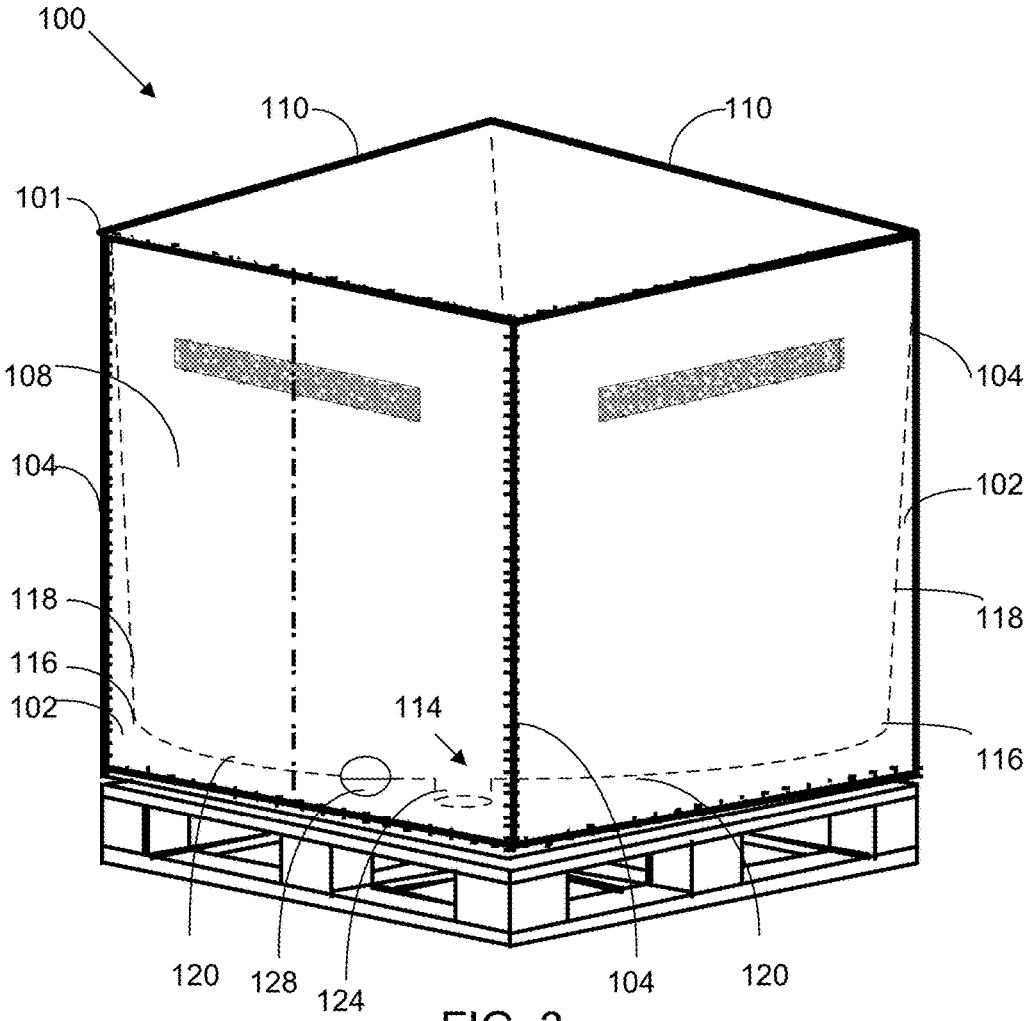

FIG. 3 shows a perspective view of a collapsible container in an aspect of the present invention.

Figure 4:
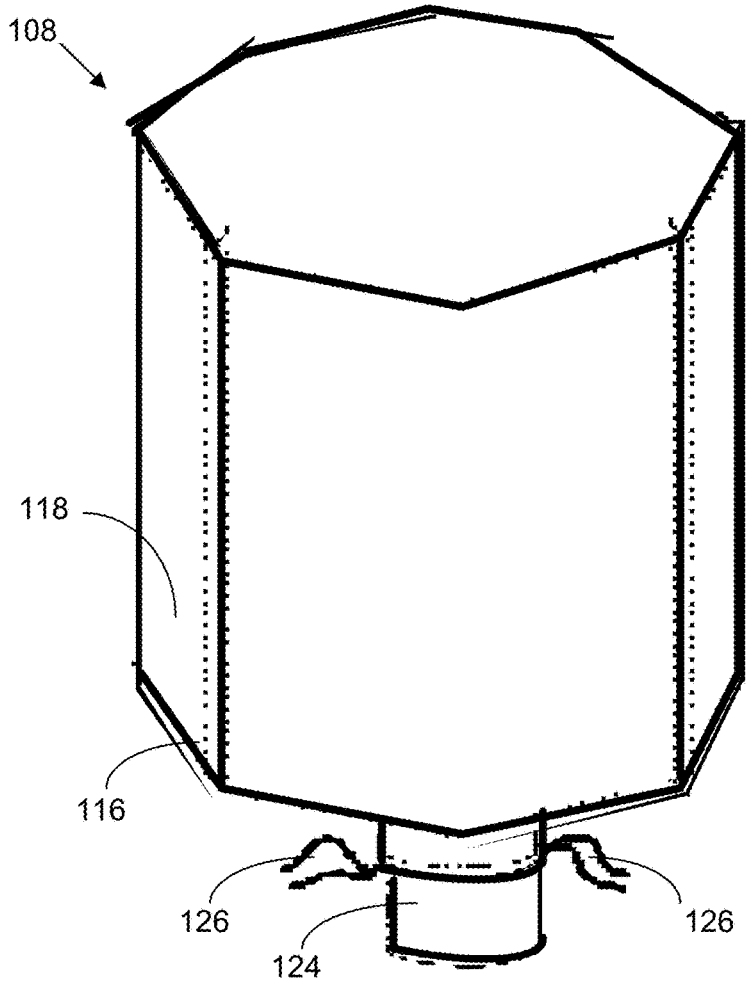

FIG. 4 shows a perspective view of a liner for the collapsible container according to one embodiment.

Figure 5:
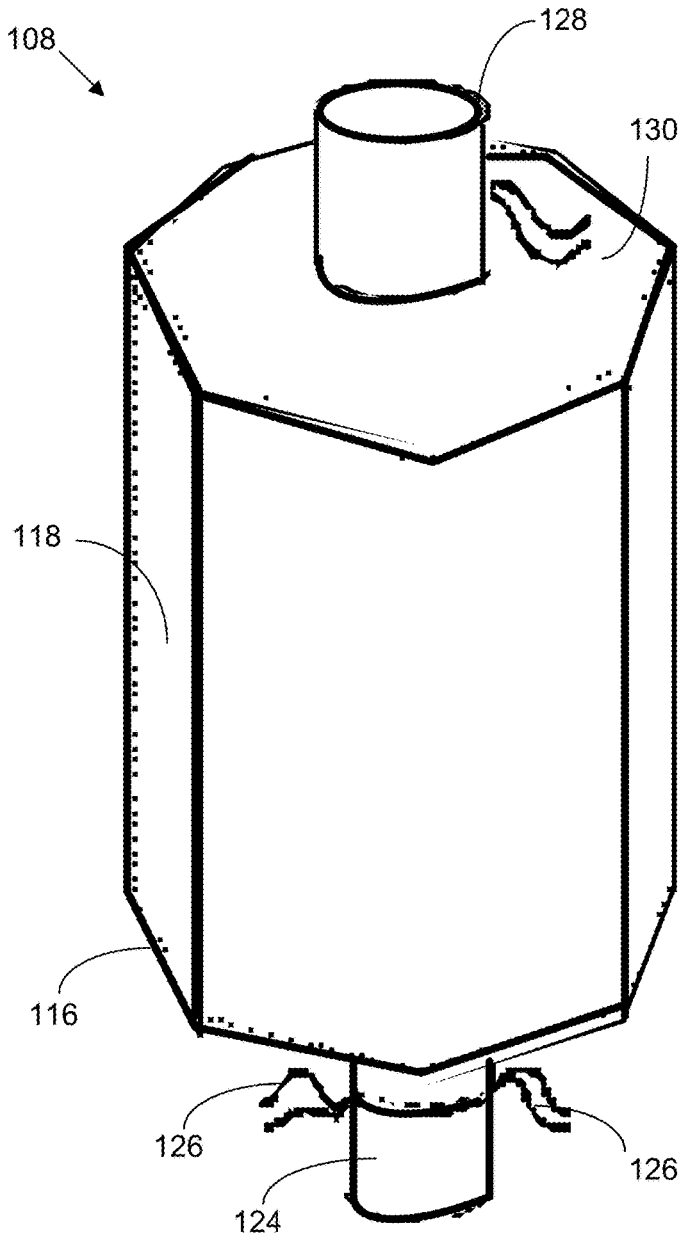

FIG. 5 shows a perspective view of a second embodiment of a liner for the collapsible container.

Figure 6:
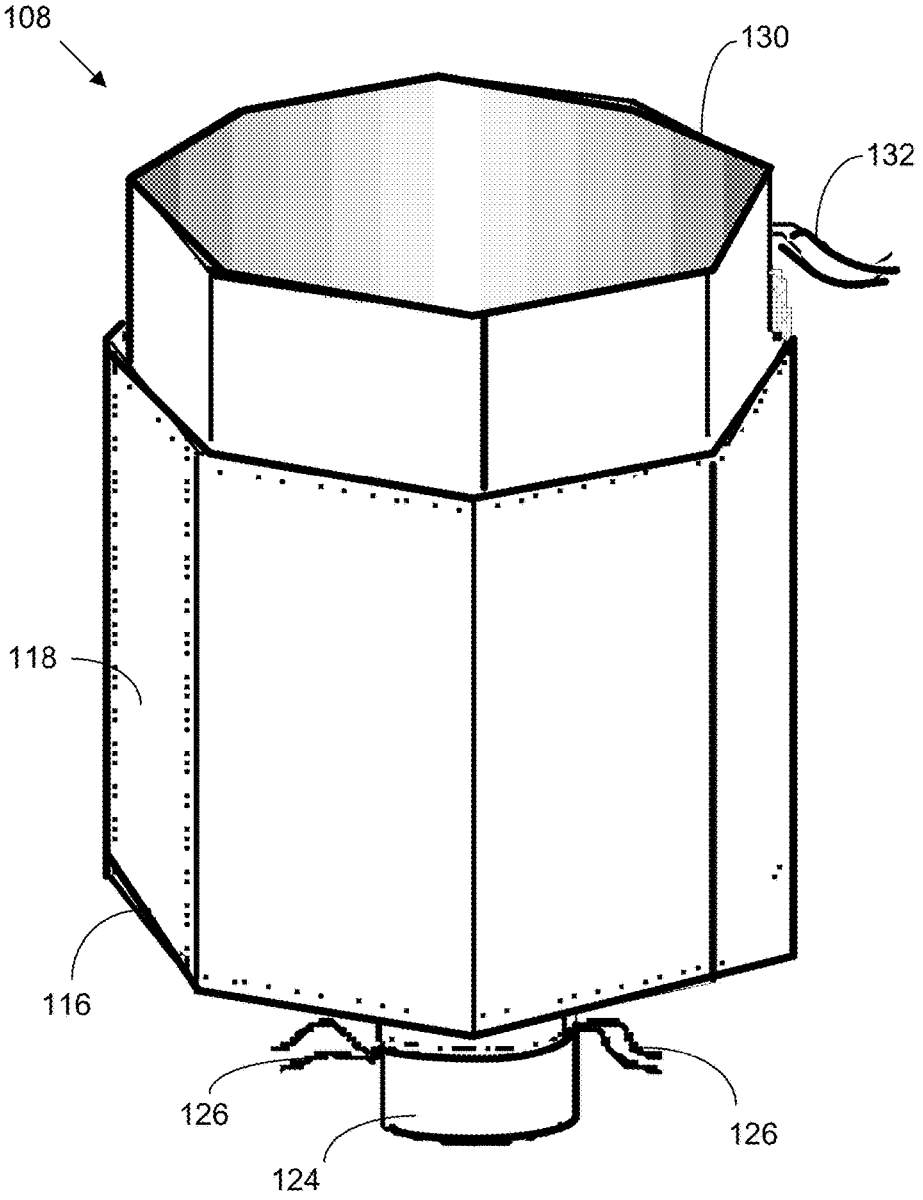

FIG. 6 shows a perspective view of a third embodiment of a liner for the collapsible container.

Figure 7:
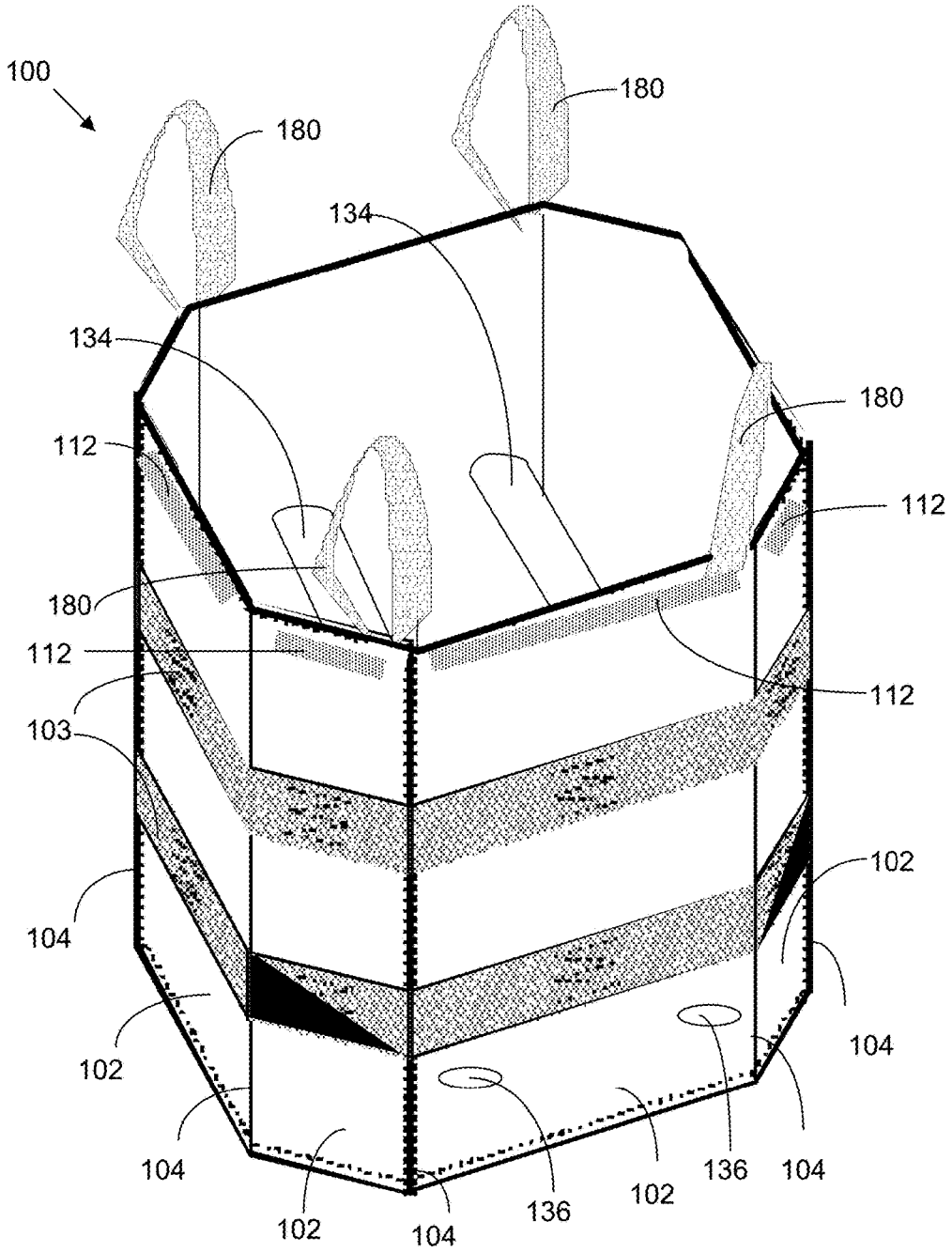

FIG. 7 shows a perspective view of a collapsible container having lift tubes according to one embodiment.

Figure 8:
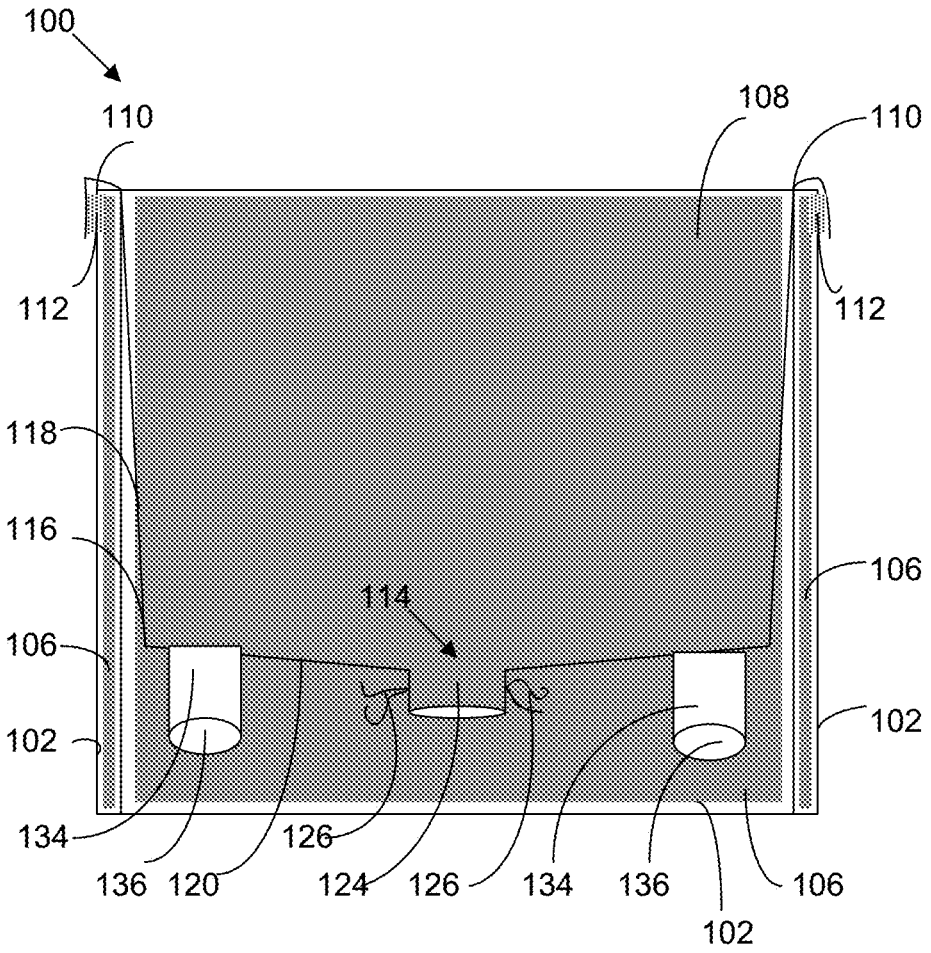

FIG. 8 shows a cutaway view of a collapsible container having lift tubes according to one embodiment.

Figure 9:
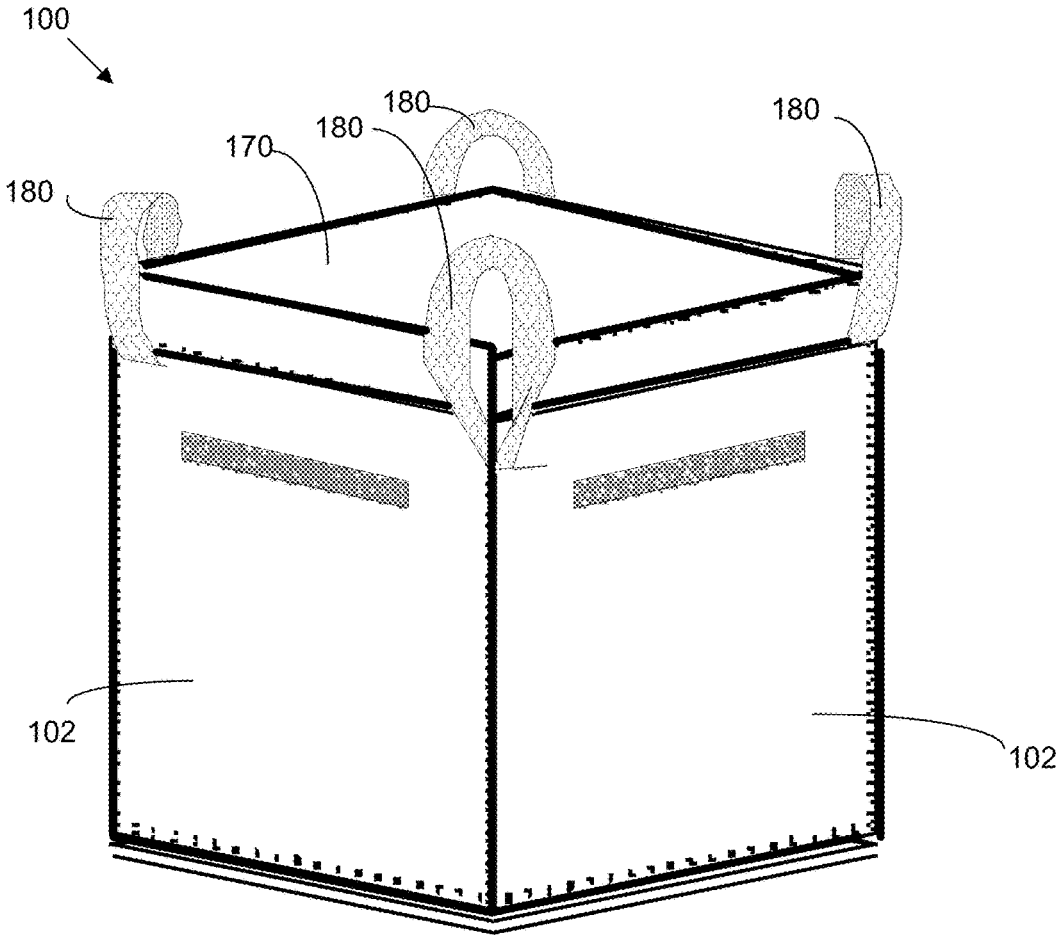

FIG. 9 shows a perspective view of a collapsible container having a lid according to one embodiment.

Figure 10:
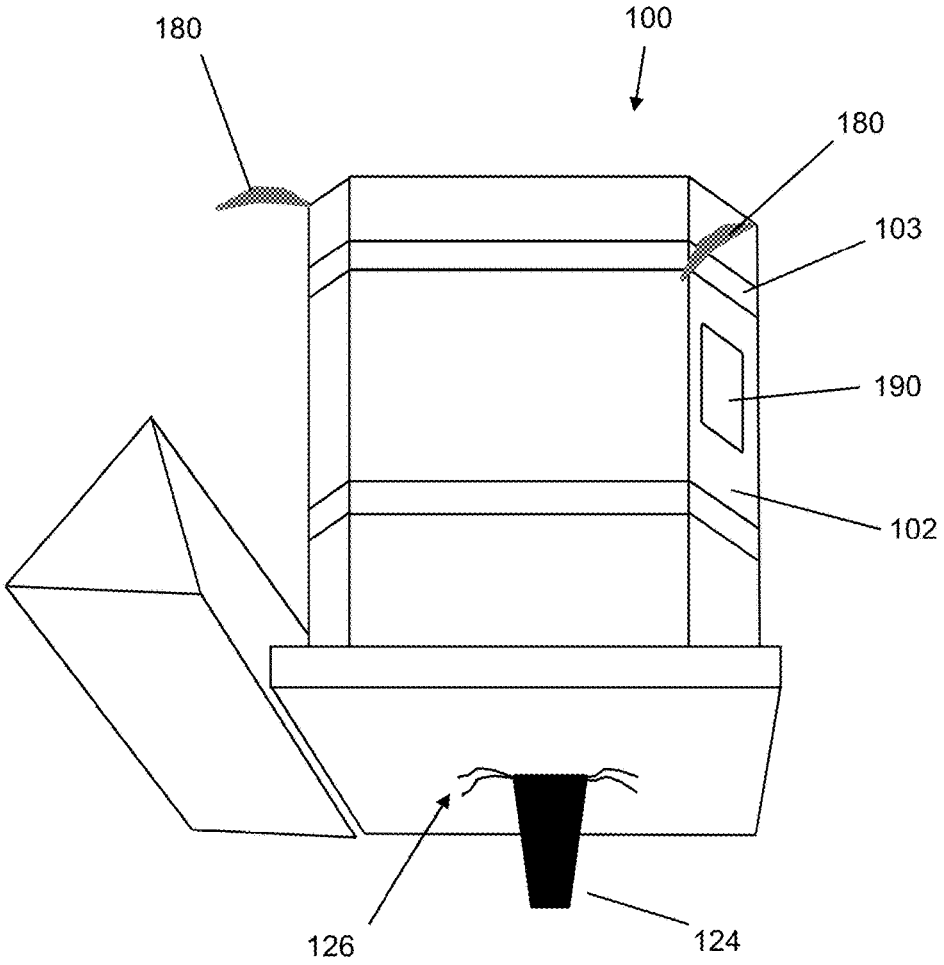

FIG. 10 shows an image of a collapsible container discharging content from a cylinder according to one embodiment.

Figure 11:
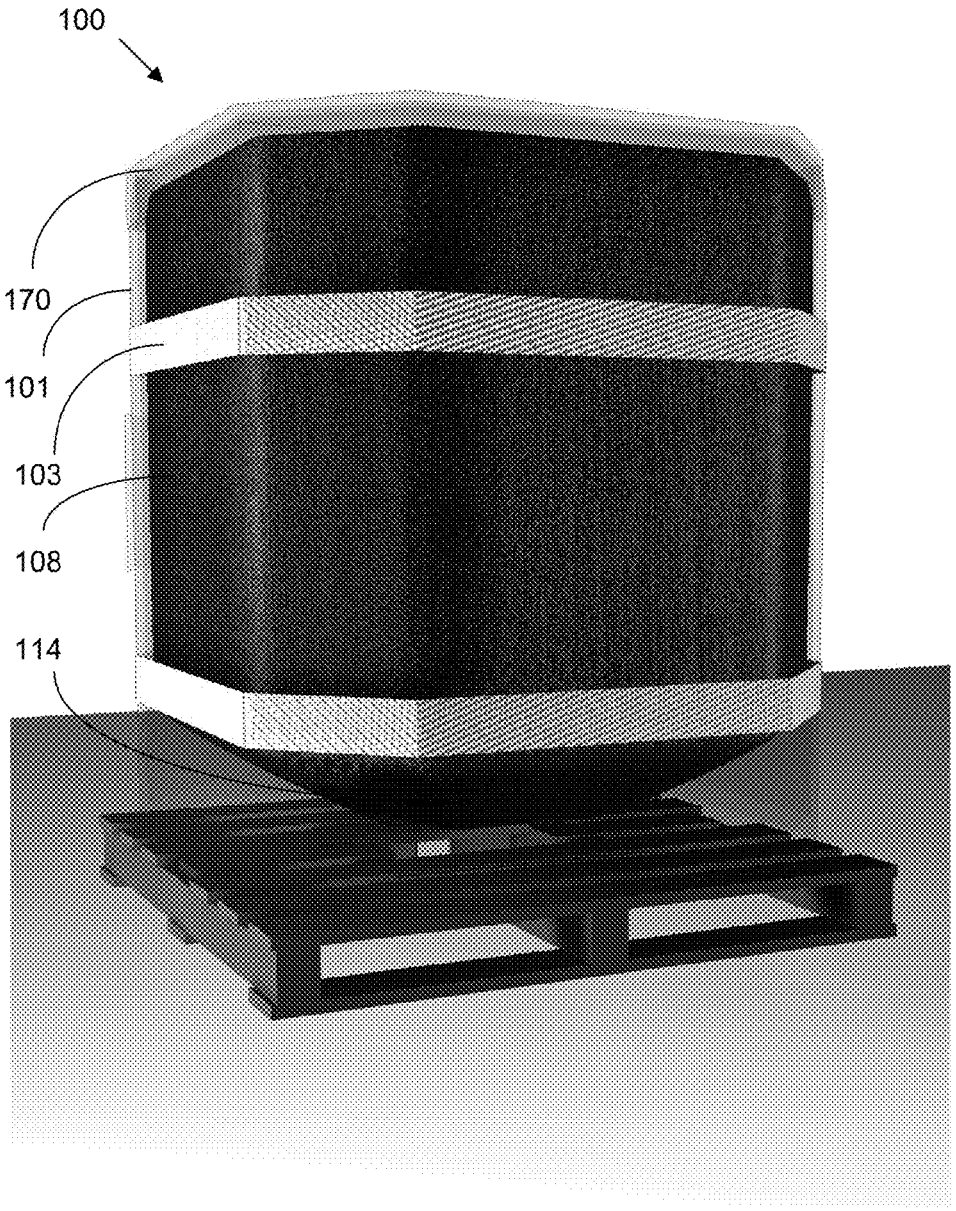

FIG. 11 shows a transparent view of a sleeve enclosing a liner in a collapsible container according to an embodiment.

Figures 12A, 12B:
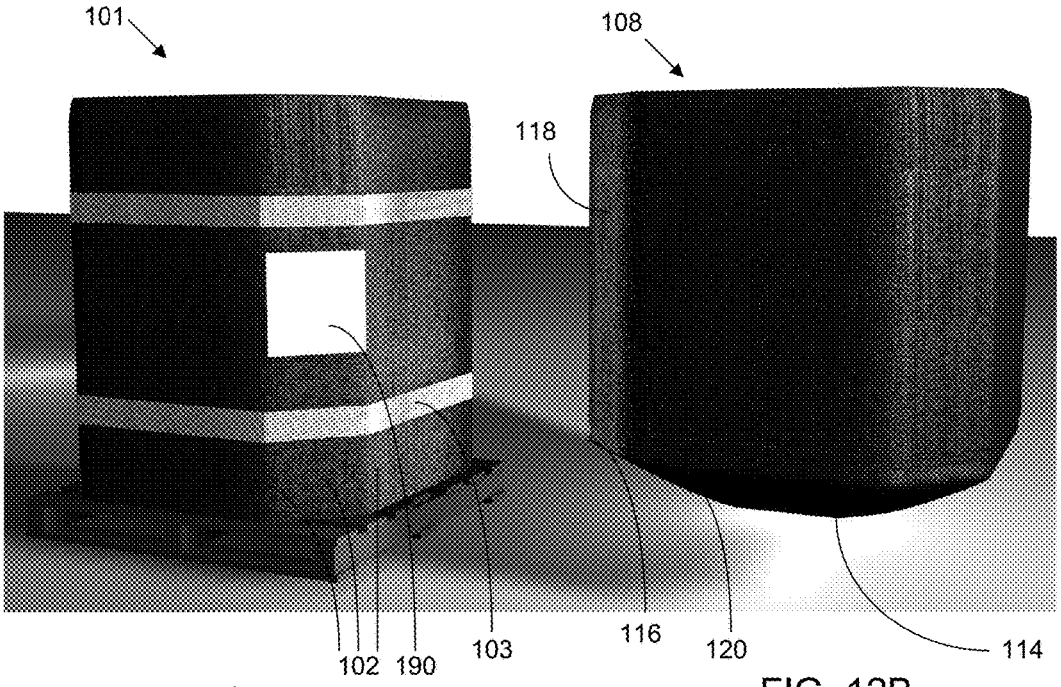

FIGS. 12A and 12B shows perspective views of a sleeve and a liner, respectively, according to one embodiment.

Figure 13:
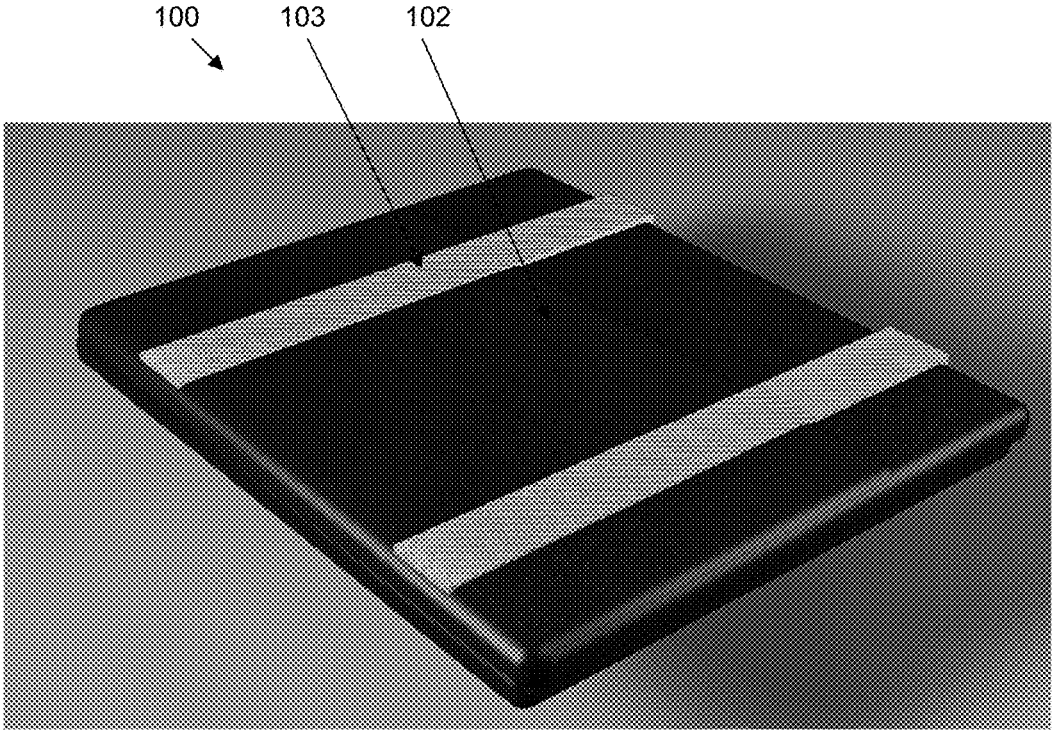

FIG. 13 shows a perspective view of a collapsed container according to one embodiment.

Figure 14:
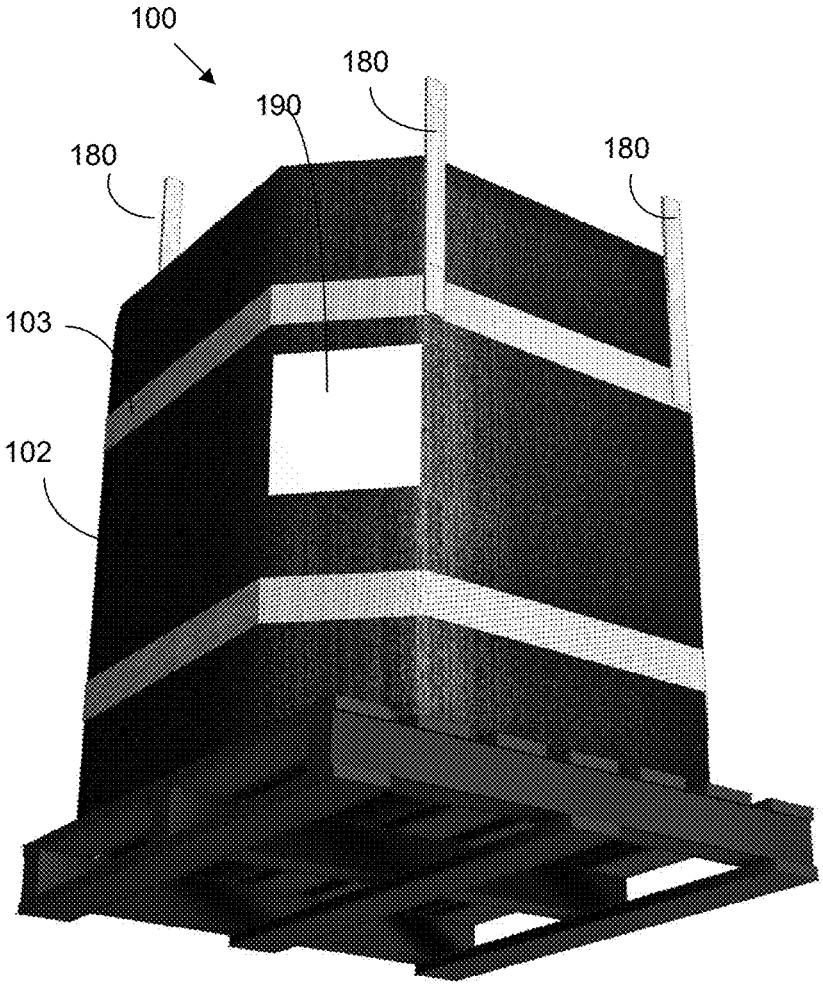

FIG. 14 shows a perspective view of a collapsible container raised on a pallet according to one embodiment.

Figure 15:
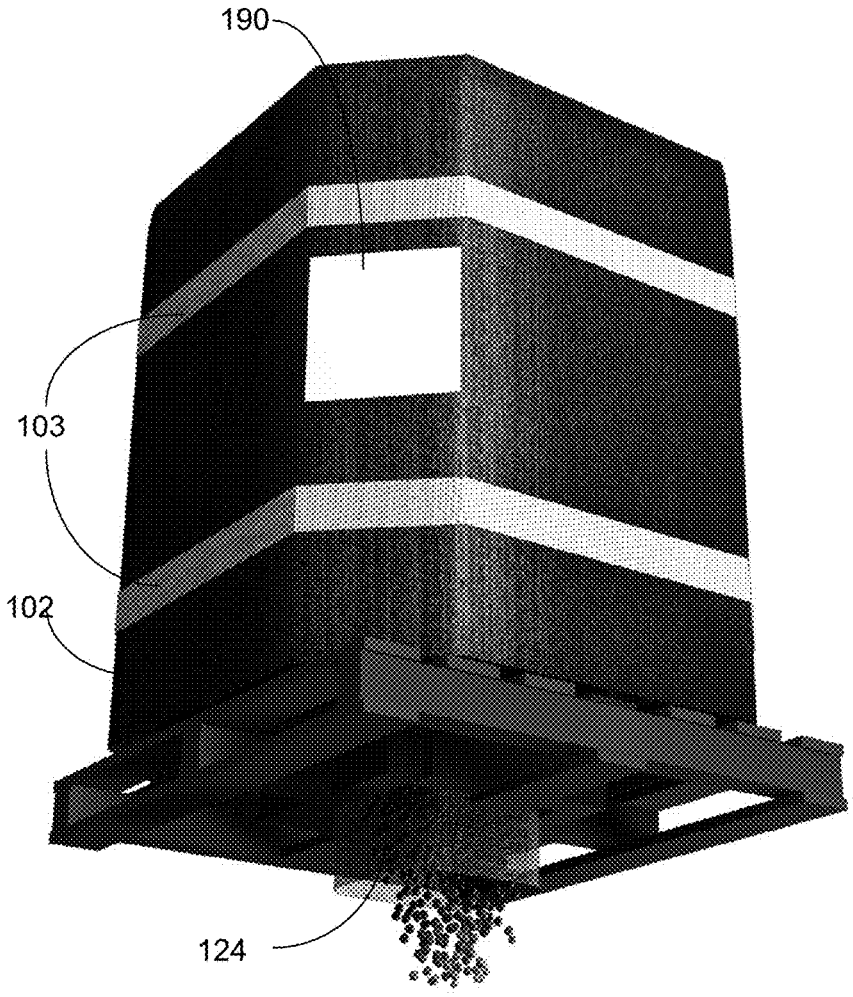

FIG. 15 shows a perspective view of a collapsible container discharging content from a cylinder according to one embodiment.

Figure 16:
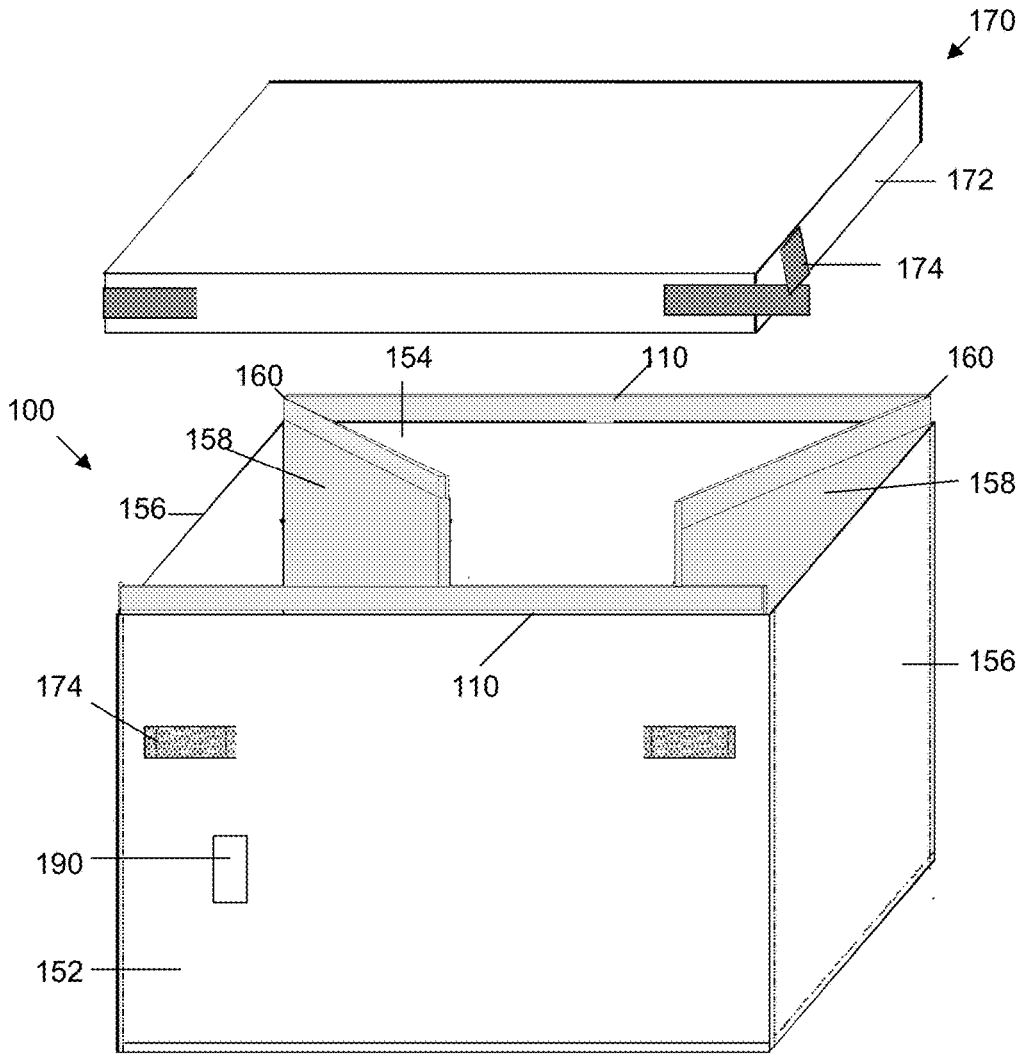
Figure 17:
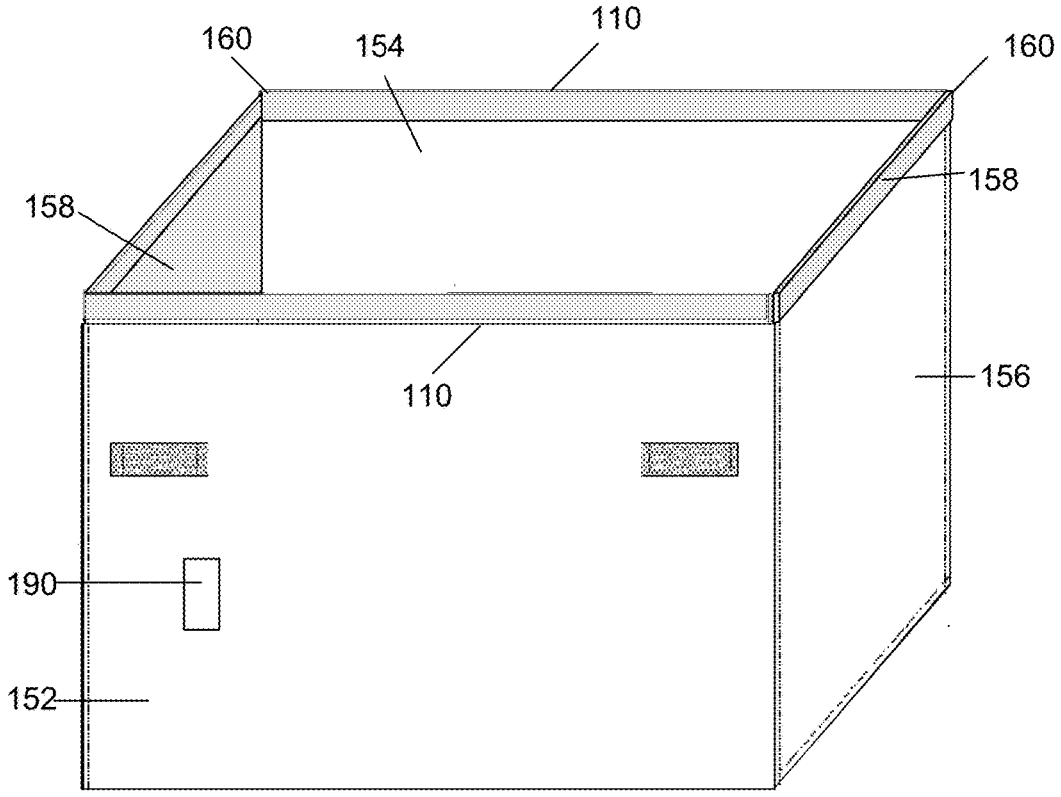

FIG. 16 shows a perspective view of a collapsible sleeve in an aspect of the present invention FIG. 17 shows a perspective view of the collapsible sleeve of FIG. 16 with the swing walls substantially adjacent the opposing side walls according to one embodiment.

Figure 18:
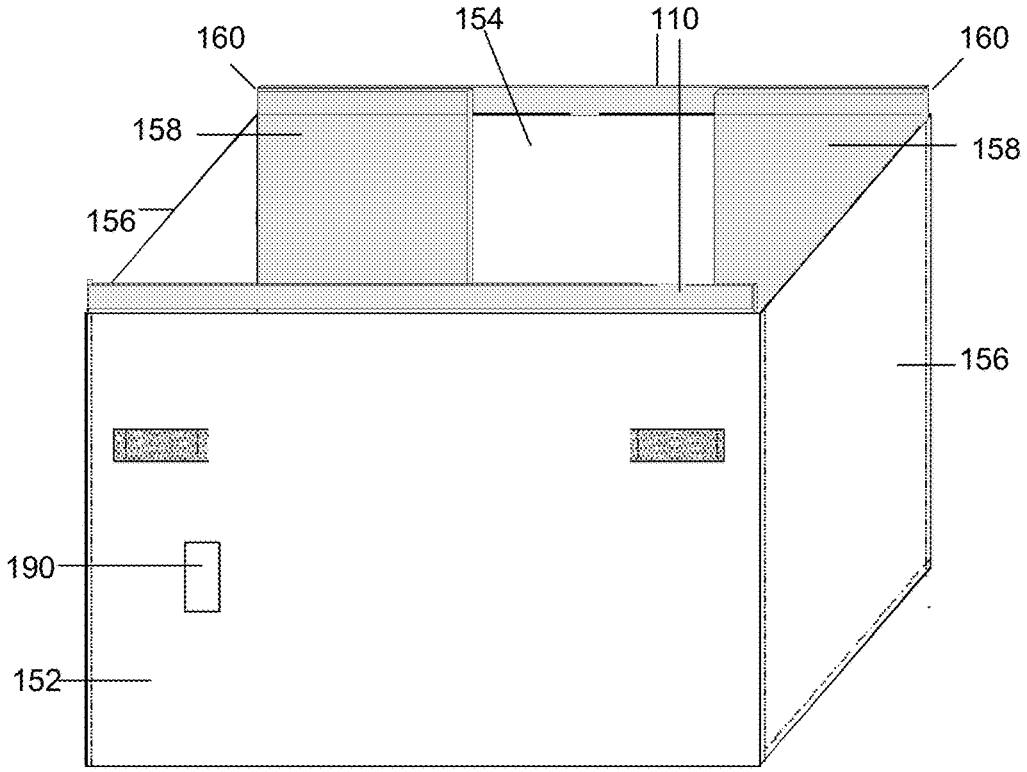

FIG. 18 shows a perspective view of the collapsible sleeve of FIG. 16 with the swing walls substantially adjacent the back wall according to one embodiment.

Figure 19:
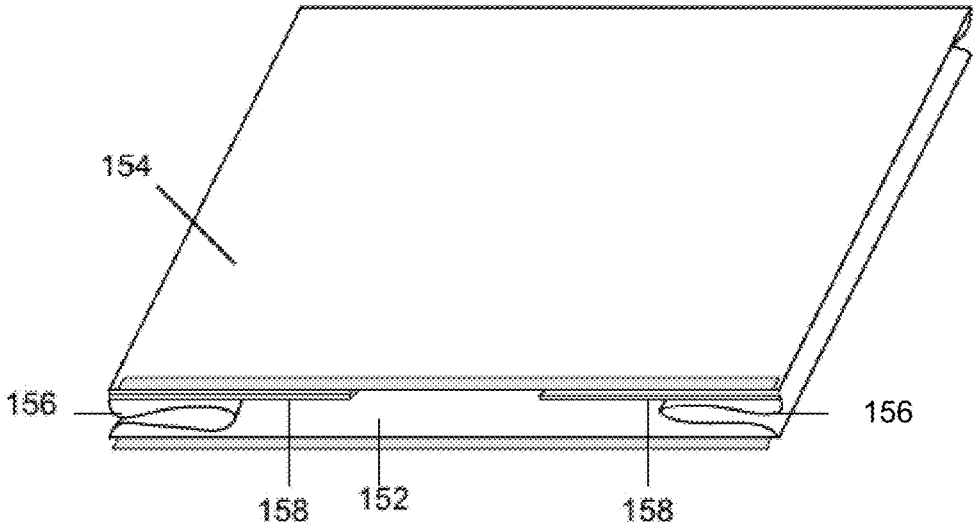

FIG. 19 shows a perspective view of the collapsible sleeve of FIG. 16 in the collapsed position according to one embodiment.

Figure 20:
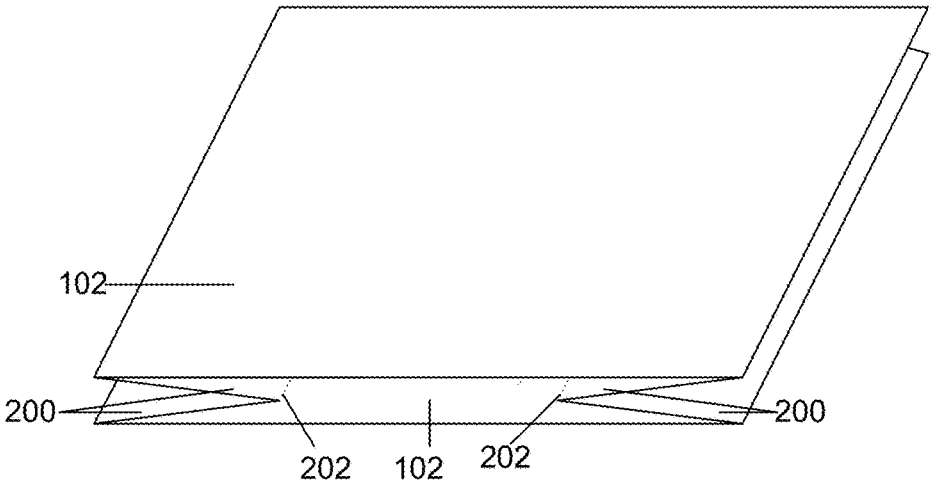

FIG. 20 shows a perspective view of the collapsible sleeve of FIG. 3 in a collapsed positioned according to one embodiment.

Figure 21A:
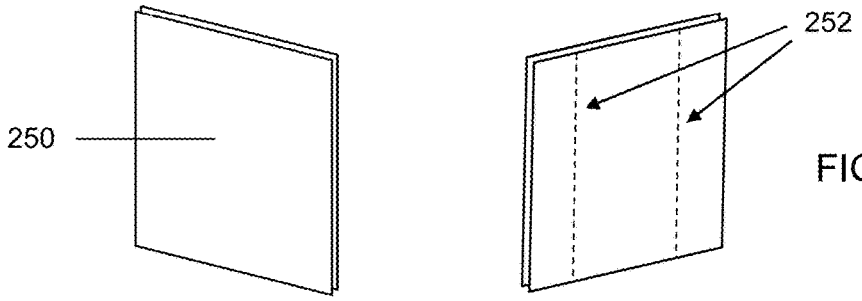
Figure 21B:
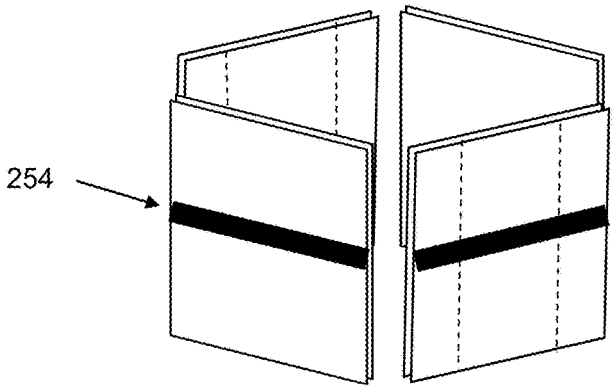
Figure 21C:
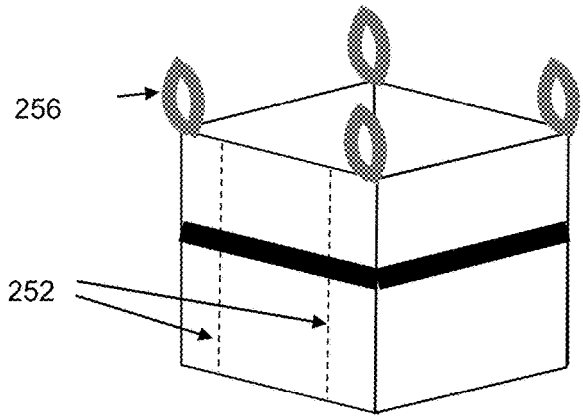

FIG. 21 shows a perspective view of a method of making a collapsible container according to one embodiment.

Figure 22A:
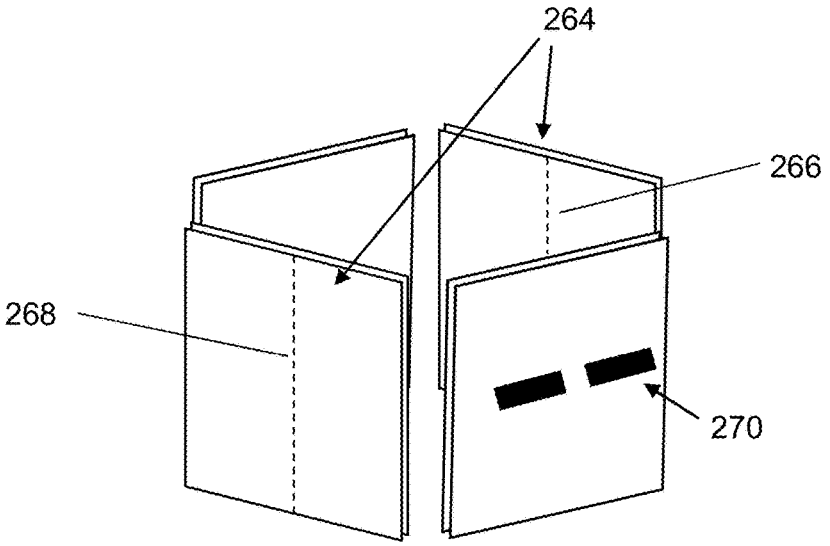
Figure 22B:
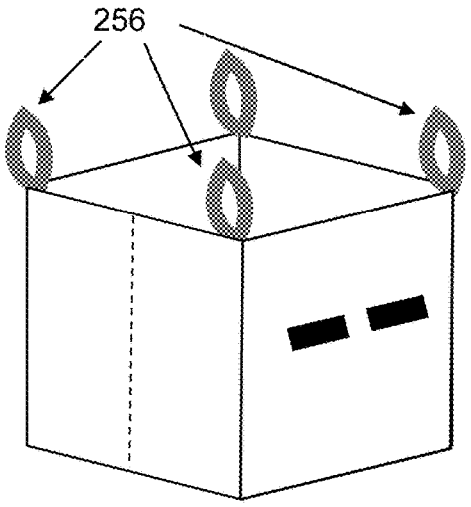

FIG. 22 shows a perspective view of a second method of making a collapsible container according to a second embodiment.

Figure 23:
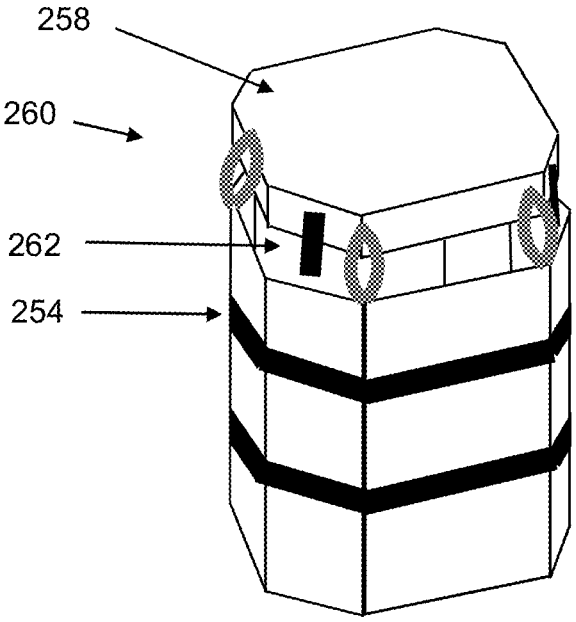

FIG. 23 shows a perspective view of a method of making a top panel for a collapsible container according to an embodiment.

DETAILED DESCRIPTION

The present invention generally relates to collapsible containers, methods for transporting and storing content in collapsible containers, and uses of collapsible containers. It is to be understood that the collapsible container described herein can be compatible with and may be used for storing and transporting any type of content. The collapsible container is easily loaded with content and allows convenient transport of the content. In an embodiment, the collapsible container is configured to receive content and then completely and automatically discharge the content at a later time. In this manner, the container reduces contamination from re-used containers and saves time and effort of users. Additionally, the containers are designed to be stackable, reusable, and collapsible. Surprisingly, the containers may be stacked up to five high while containing loads of up to about 2000 kg each. Plastic rigid panels in the walls of the collapsible container support less weight per square inch than plywood rigid panels, but both types of panels are appropriate for the walls of these containers. The container easily meet the minimum federal requirements of a 6:1 safety factor for a safe working load of up to about 2000 kg. This meets the U.S. Department of Transportation requirement for a re-usable flexible intermediate bulk container classification.

The design of the collapsible container minimizes bulging sides caused by heavy loads. An internal liner connecting to the top edge of the collapsible container results in the load in the container exerting a primarily vertical force on the walls of the container. Additionally, the containers weigh less than metal, wood, or plastic containers but can store products and be transported with at least the same level of efficiency. Further, the synthetic material used to manufacture the walls eliminates concerns related to cardboard or plywood such as dust that can contaminate pharmaceutical, seeds, food and personal hygiene products or damage sensitive equipment.

Any type of product may be transported in the containers. For example, solids or liquids can be transported in the collapsible containers. Solids can include, but are not limited to, biological products, seeds, powders, pre-formed components, and semi-solids. Liquids can include, but are not limited to, heavy oils, cooking fluids, and other viscous, semi-viscous, or non-viscous fluids. Specific examples of types of content than can be transported and stored in the containers include, but are not limited to, seeds, pharmaceuticals, personal hygiene components, and food products. Advantageously, the container may be loaded with seed, stacked, transported to a facility, completely unloaded from a discharge port in the bottom of the container, and then folded for transport and re-use. Once the container is loaded, an internal liner is configured so that the content is completely and automatically discharged by gravity when a discharge port is opened.

Thus, the present application provides a simple apparatus and method for reusable collapsible containers that provide convenient, safe, and complete discharge of content.

Embodiments of the present invention will now be described more fully hereinafter with reference to the accompanying drawings, in which some, but not all, embodiments of the invention are shown. Indeed, the invention may be embodied in many different forms and should not be construed as limited to the embodiments set forth herein; rather, these embodiments are provided so that this disclosure will satisfy applicable legal requirements. Where possible, any terms expressed in the singular form herein are meant to also include the plural form and vice versa, unless explicitly stated otherwise. Also, as used herein, the term "a" and/or "an" shall mean "one or more," even though the phrase "one or more" is also used herein. Furthermore, when it is said herein that something is "based on" something else, it may be based on one or more other things as well. In other words, unless expressly indicated otherwise, as used herein "based on" means "based at least in part on" or "based at least partially on." Like numbers refer to like elements throughout. Additionally, while embodiments are disclosed as "comprising" elements, it should be understood that the embodiments may also "consist of" elements or "consist essentially of" elements.

FIG. 1 is a perspective view, respectively, of a collapsible container 100 in one aspect of the present invention. The container 100 includes between four and eight wall panels 102 connected end to end to form a sleeve 101. A sleeve is a rigid yet collapsible cylinder. In some embodiments, the cylinder includes two open ends. In an exemplary embodiment, eight wall panels 102 are connected end to end to form an octagonal sleeve 101. The wall panels 102 are rigid and connected to adjacent wall panels 102 by a flexible weld or seam. The flexible weld or seam allows the wall panels 102 to fold inward and transition the container 100 from a free-standing container supported by the wall panels 102 to a flattened container convenient for storage and transport. Other embodiments providing a collapsible yet supportive sleeve 101 are also provided. A liner 108 is connected to an exterior edge 110 of the wall panels 102 at one end of the sleeve opening and extends through the sleeve 101 to an apex 114 on an opposing end. The apex is an opening at an end of the liner 108 such that complete discharge of the contents of the liner 108 by gravity occurs. The liner 108 is sized so that the liner 108 is suspended in the container 100 when the container 100 is free-standing. When the liner 108 contains content, the weight of the content causes the base of the liner to be angled away from horizontal, as will discussed in further detail. In an embodiment, the liner includes an opening at the apex 114 through which content can be discharged from the container. In a further embodiment, the container 100 includes straps 103 wrapping substantially horizontally around the container. The straps 103 can be on the inside or outside of the sleeve 101 and are configured to prevent the sleeve 101 from bulging outwards when content is filling the liner 108.

In an embodiment, the containers are produced in base dimensions from as small as 20 inches by 20 inches to as large as 48 inches by 96 inches. In some embodiments, the containers have a height from between 5 inches and 200 inches tall, more preferably between 20 inches and 96 inches. The containers, however, may be produced in any size including those sizes designed to fit standard or custom pallet measurements, domestically or internationally. For example, the containers can be 40×48 inches, 40×40 inches, 42×42 inches, or 48×48 inches in length and width dimensions. In another example, the containers can be sized to correspond to international pallet dimensions, such as 1000×1200 millimeters, 800×1200 millimeters, or 800×600 millimeters.

The wall panels are constructed of materials such as woven polypropylene, polyethylene, PVC vinyl, urethane vinyl, or any other fabric or film of appropriate strength. For example, woven polypropylene fabric having a weight of between 3 to 10 ounces per square yard or 6-35 mil film, preferably between 4 to 8 ounces per square yard, and most preferably of about 6.5 ounces per square yard can be used to construct the containers.

In one embodiment, the wall panels are constructed by sewing two layers of woven polypropylene or woven polyethylene fabric together to create a wall panel having a pocket between the layers. In another embodiment, the wall panels are welded together to eliminate needle holes and create the pocket. Advantageously, welding provides a sealed environment in the container suitable to meet sterile and/or food storage standards. The material can be welded together by any type of welding including hot gas welding, freehand welding, speed tip welding, extrusion welding, contact welding, hot plate welding, high frequency welding, ultrasonic welding, friction welding, laser welding, and solvent welding.

The pockets in the wall panels are designed to receive panels that provide rigidity and support to the container. Each wall can have a single pocket or multiple pockets. If the wall is designed with multiple pockets, each pocket can be defined by a sewn or welded seam. In one embodiment, the pockets have the panels placed therein and are then sealed shut (e.g., sewn or welded shut) to prevent the panel from falling out. In another embodiment, the pockets are open at one end or are reversibly sealable, such as by Velcro, a zipper, or other attachment means. Pockets that open allow the panels to be easily removed for transport or replacement.

The rigid panels can be made of plastic, engineered wood product, corrugated paperboard, cardboard, or other suitable materials. The plastic can be corrugated or flat. Corrugated plastic can be between 4 mil and 25 mil thick, preferably between 10 mil and 16 mil thick, most preferably about 13 mil thick, and can be the type known as Interpro™. Optionally, plywood can be from ⅛ inch thick to 2 inches thick, preferably from ¼ inch thick to 1 inch thick, most preferably about ½ inch thick. Additionally, different weight panels can be used for different parts of the container.

In an exemplary embodiment of the container depicted in FIGS. 1-3, the container 100 includes an octagonal or rectangular sleeve 101 comprising wall panels 102 welded or sewn together at flexible seams 104 so that adjacent wall panels are connected to one another. The octagonal shape is slightly more efficient in the use of interior space in the sleeve while the rectangular shape is slightly more efficient in storing containers when free-standing. In an embodiment, each of the wall panels includes a single pocket enclosing a rigid panel 106 (shown in FIG. 2). In one embodiment, the wall panels are configured to transition between a free-standing position (shown in FIGS. 1, 3, 7, 9, 10-12, 14, and 15) where the container is supported by the rigid panels 106 and a substantially flattened position (shown in FIGS. 13, 19, and 20) where the container may easily transported and stored. In one embodiment, the container transitions between the free-standing position and the flattened position by folding at the flexible seams 104 until the wall panels 102 are substantially adjacent one another.

The container includes a liner 108 attached to a top edge 110 of the wall panels 102 and suspended between the wall panels 102 defining the sleeve 101. The liner 108 is manufactured from coated or uncoated fabric, polyethylene, vinyl, etc. The liner 108 is attached to the top edge 110 of the wall panels 102 on the inside or outside edge of the wall panels 102. In one embodiment, the liner 108 is permanently attached to the top edge 110 of the wall panels 102, such as by adhesive, welding, or sewing. When stitching attaches the liner 108 to the interior of the wall panels 102, the wall panels may bulge outwards. To reduce this possibility, in some embodiments the straps 103 are including on the exterior of the sleeve 101. In another embodiment, however, the liner 108 is removably attached to the top edge 110 of the wall panels 102, such as by Velcro, grommets, hook and loop fasteners or the like. As shown in FIG. 2, in an exemplary embodiment the liner 108 is attached to the wall panels 102 by an attachment device 112 (e.g., heavy duty Velcro, etc.) attached to the exterior of the top edge 110 of the wall panels 102. The edge of the liner 108 overlaps the tope edge 110 of the wall panels 102. Velcro on the top edge 110 of the liner 108 mates with Velcro on the outside top edge 110 of the wall panel 102, thereby securing the liner 108 to the sleeve 101. In this configuration, the angle of force on the wall panels 102 from a loaded liner 108 is primarily in the vertical direction and does not pull the wall panels 102 inward or force them outward. Further, the angle of attachment between the liner 108 and the wall panels 102 results in a shear force that is insufficient to separate the liner 108 from the wall panels 102 based on the weight of the content. A portion of the liner 108 is supported on the rigid panel 106 and reduces the force applied to the Velcro or other attachment means 112 when the liner 108 is curved over the top of the wall panel 102 and attached to the exterior of the container 100.

When suspended in the sleeve 101, the liner 108 forms an apex 114 at the end not connected to the wall panels 102, as shown in FIGS. 2, 3, and 8. In an embodiment, the liner 108 extends downward from the top edge 110 of the wall panels in a substantially vertical orientation. The liner changes from a substantially vertical orientation to a substantially horizontal orientation at an inflection point 116. The inflection point defines sides 118 and an angled base 120 in the liner 108. In an exemplary embodiment, the apex 114 is formed in the center of the angled base 120, although the apex may be at any location in the angled base so that content in the liner drains to the apex. As shown in FIG. 2, the apex 114 is a vertical distance z from the inflection point 116, such that $z>0$. The vertical distance z can vary in magnitude based on the size and shape of the container 100 as well as the location of the apex 114 in the angled base 120 (e.g., some location other than the center).

The liner 108 is sized relative to the sleeve 101 so that when the liner 108 is filled with content, the apex 114 does not extend to the end of the sleeve 101. In this manner, the content in the liner 108 is suspended above the surface upon which the sleeve 101 is resting, such as a pallet, the ground, etc. By suspending the liner 108 in the sleeve 101 and forming an apex 114 in the angled base 120, the container 100 biases content towards the apex 114. As will be discussed, an opening 122 and/or cylinder 124 at the apex 114 will allow the content to be conveniently and completely discharged from the container 100 without requiring user effort.

In some embodiments, the apex 114 includes an opening 122 in the liner 108 at the apex 114. In other embodiments, the apex may include a cylinder 124 that extends from the opening 122 so that discharge of the content can be directed. In an exemplary embodiment, the cylinder 124 is integral with and manufactured from the same material as the liner. The cylinder 124, however, may be attached to the liner 108 or manufactured from a different material. Also, the cylinder 124 may be flexible, similar to the liner 108, or rigid. When rigid, the cylinder 124 assists the user in directing the content when discharging from the container 100. The opening 122 and cylinder 124 may have any diameter. A larger diameter opening 122 results in faster discharge of content but is also more difficult to seal. If the opening 122 includes a cylinder 124 that extends from the opening 122, the cylinder 124 may have any length and diameter. In an embodiment, the cylinder 124 extends far enough below the edges of the sleeve 101 such that the cylinder 124 can direct content from the container 100 into a receptacle placed below the container 100. For example, the sleeve 101 can be placed on a pallet having a hole in it. The user can direct the cylinder 124 through the hole and into a receptacle placed beneath the pallet. In this manner, the container 100 can be lifted from underneath, e.g., using a forklift, rather than from loops attached to the top, resulting in a safe discharge method. In still further embodiments, the cylinder 124 is long enough to attach to the exterior of the sleeve 101 from the bottom of the container 100. In this embodiment, the user can manipulate (open and close) the cylinder 124 easily from the side of the container 100 without having to walk underneath the loaded liner 108. In some embodiments, the cylinder 124 has a consistent diameter but the cylinder 124 may also narrow or widen in diameter as it extends from the opening 122 at the apex 114 to a spout at the end of the cylinder.

The cylinder 124 includes a sealing mechanism 126 that closes the cylinder 124 and retains content in the liner 108. In an embodiment, the sealing mechanism 126 is a flexible device such as rope, tie string, Velcro strap, draw strings, or cable ties. For example, the cylinder 124 can be sealed by using a rope to tie off the cylinder. The flexible device may include a draw string that extends to the exterior of the sleeve 101 so that the user can pull the draw string to undo the sealing mechanism 126 without having to walk underneath the container 100. In another embodiment, a second cylinder (not shown) is placed over the first cylinder 124 and both are independently sealed, as described herein. While not necessary, this double cap provides redundancy and assists in maintaining content in the liner 108 until the user desires to discharge the content. In some embodiments, the sealing mechanism 126 is a rigid device (not shown), such as a clip, that seals the cylinder 124. For example, a spring-loaded or pressure clip may seal the cylinder 124 closed so that content is not discharged from the liner 108 until the user removes the clip. Various means of removing the sealing mechanism are possible. For example, the sealing mechanism 126 can be positioned so that when the sleeve 101 is lifted, such as by a fork lift raising a pallet, the user can reach between the boards of the pallet and access the sealing mechanism 126. In a preferred embodiment, the user accesses the sealing mechanism 126 from the side of the container so that the user does not need to stand below the container 100. In a still further embodiment, at least one of the wall panels includes an access port 128 through which the user can reach and undo the sealing mechanism 126, as shown in FIG. 3.

In another embodiment, a blade is used to undo the sealing mechanism 126. For example, at least one blade may be inserted through the boards of a pallet on which the sleeve is resting. The blade is configured to undo the sealing mechanism 126, such as a string. In a further embodiment, the blade slides substantially perpendicularly to the cylinder 124 and cuts open the tip of the cylinder 124. In an embodiment, the blade is made integral with a pallet or stand on which the sleeve 101 rests.

In some embodiments, a porthole design is used wherein the opening does not include a cylinder 124. A porthole is an opening in the liner 108 at the apex 114 that includes a flap of material that removably seals the opening 122. For example, the flap of material may be square and permanently attached to the liner 108 at one side of the opening 122. The flap of material is removably attached to the liner 108 by Velcro, pinch clips, clip ties, buckles, rope, webbing, or the like on at least one of the other sides of the opening 122 and seals the opening 122 until the user opens the porthole. In an embodiment, the flap of material is larger than the opening 122 so that the pressure of the content in the liner 108 seals the edges of the opening 122 to the flap of material, thus preventing content from accidentally discharging from the liner 108. Velcro could also be adhered completely around the flap of material to prevent content from accidentally discharging. When the porthole is opened, content discharges from the opening 122 in the liner.

In a still further embodiment, an internal bladder is used to seal the liner 108. The internal bladder may be a second liner that is placed substantially adjacent to the first liner 108. In an exemplary embodiment, the bladder does not include an opening and is shaped to match the liner 108 attached to the wall panels 102. A bladder cylinder may extend from the bladder and may exit the liner cylinder 124, wherein the bladder cylinder is sealed shut. When the user wants to discharge content from the container 100, the user cuts open the bladder cylinder and discharges content through the cylinder 124. The previously mentioned blade that swipes substantially perpendicularly to the cylinder 124 may be used to cut open the tip of the bladder cylinder. In this embodiment, the bladder is discarded after use because the bladder has been pierced. In some embodiments, bladders that are designed to be discarded are preferable because they reduce potential contamination from re-used liners.

In some embodiments, the container also includes a bottom portion (not shown). The bottom portion can be a single piece of fabric or material, as defined herein, attached to the bottom edge of the wall panels. The bottom portion can be made with a bottom discharge opening through which the cylinder 124 extends. The bottom discharge opening allows the cylinder 124 to extend from the liner 108 and expel contents when the container 100 is lifted. The bottom portion includes a removable rigid panel that is configured as a slide gate. Prior to loading the liner 108, a rigid panel is inserted through a sleeve formed in the bottom portion. In an embodiment, the rigid panel is recessed slightly in the sleeve 101 so that the opening 122 at the apex 114 of the liner 108 rests against the rigid panel and the pressure prevents content from accidentally discharging from the liner 108. When the user desires to discharge the content, the sleeve is positioned over the receptacle or discharge area and the slide gate is opened. The opening 122 at the apex 114 of the liner 108 is then free to discharge content from the container.

Embodiments of the liner are shown in FIGS. 4-6. FIG. 4 presents an exemplary liner 108 with sides 118 switching to an angled base (not shown) at an inflection point 116. The cylinder 124 extends from an apex (not shown) in the angled base. In another embodiment shown in FIG. 5, the liner 108 includes an access port 128 in a cap 130 of the liner. The access port 128 is an opening that is narrower than the diameter of the liner 108 at the widest point. The access port 128 reduces spillage when the container 100 is being loaded with content. A tube can be placed into the access port 128 to fill the liner 108 and content will not spill over the sides of the liner 108 because of the cap 130 surrounding the access port. In another embodiment, the liner 108 includes a draw string 132 and cap 130 as shown in FIG. 6. The liner 108 allows content to be easily loaded into the body of the liner 108 but when the liner 108 is full, the draw string 132 can be pulled and the liner 108 secured against spillage by the cap 130. The liners 108 are attached to the top edges 110 of the wall panels 102 between the cap 130 and the sides 118 of the liner 108.

Normally, the container is put on a pallet, such as a wood or plastic pallet. In some embodiments, the pallet includes a hole through which the cylinder 124 can be extended to discharge content. The pallet can be lifted using a forklift, the sealing mechanism can be reached from the side of the pallet through the boards defining the pallet, and the user can safely move and discharge the content without walking underneath the container.

In a still further embodiment, the container includes lift tubes 134. The lift tubes 134 extend from a first wall panel 102 to an opposing wall panel 102 and can be manufactured from flexible or rigid materials. For example, referring to FIG. 7, a pair of fabric cylinders can be sewn or welded to openings 136 in the opposing wall panels 102, forming a pair of lift tubes 134 extending through the container 100 from one side to the opposing side of the container 100. The lift tubes 134 serve as guides for forklift tines that can be extended through the lift tubes 134 to conveniently and securely lift the container. When raised, the forklift tines in the lift tubes 134 press against the rigid panels 106 in the wall panels 102 and lift the container 100. As discussed, the lift tubes 134 can be flexible and manufactured from fabric materials. In another embodiment, however, the lift tubes 134 are rigid and manufactured from PVC pipe, rotational or injected molded plastic, or other rigid materials. In a still further embodiment, openings 136 are provided in the wall panels 102 but no lift tube 134 is extended through the container 100. The openings 136 are spaced on the container 100 so that the tines of a forklift may go through the openings 136 and lift the container 100. In some embodiments, the openings 136 on one side are smaller then the openings 136 on the opposing side. The user inserts the forklift tines in the smaller openings 136 and then is able to easily find the openings 136 on the opposing side because of the larger size.

In another embodiment of the container depicted in FIGS. 16-19, the container 100 includes a front wall 152 and a back wall 154 having a single pocket and opposing side walls 156 manufactured from a single sheet of fabric. It should be understood that many variations of rigid wall panels and flexible wall panels are possible by combining wall panels that have a pocket for receiving a rigid panel and wall panels composed of a single sheet of fabric.

In the embodiment depicted in FIGS. 16-19, the container 100 includes two swing walls 158. An end of each swing wall is attached to a corner 160 between the back wall 154 and the opposing side walls 156. The swing walls 158 are constructed of similar material and have pockets constructed in a similar manner as the exterior wall panels of the container. A rigid panel 106 can be placed in the swing wall pockets to provide support to the swing walls 158. The swing walls 158 are designed so that they are movable between a first position substantially adjacent to the back wall and a second position substantially adjacent to the opposing side walls. As used herein, the term "substantially adjacent" means positioned next to and contacting or coming close to contacting.

In the embodiment depicted in FIG. 17, the swing walls 158 are sized to extend the length of the opposing side walls 156 when the swing walls 158 are substantially adjacent to the opposing side walls 156. Velcro or other attachment means (not shown) may be placed on the opposing side walls 156, the back wall 154, and/or the swing walls 158 to reversibly secure the swing walls 158 in the first position or the second position. When the swing walls 158 are substantially adjacent to the opposing side walls 156, the container is freestanding, able to receive content, supports stacking, and is able to be box dumped without collapsing. The liner 108 may be permanently or removably attached to the top edge 110 of the front wall 152 and the back wall 154, as discussed herein.

In another embodiment depicted in FIG. 18, the swing walls 158 are substantially adjacent to the back wall 154 and the container 100 may be collapsed. In an embodiment, the opposing side walls 156 do not have panels and the container 100 is only freestanding when the swing walls 158 are located substantially adjacent to the side walls 156. As shown in FIG. 19, when the swing walls 158 are substantially adjacent to the back wall 154, the container 100 can be collapsed so that the opposing side walls 156 fold in and are contained with the swing walls 158 and the liner 108 between the back wall 154 and the front wall 152.

In some embodiments shown in FIGS. 9 and 16, the container includes a lid 170. In an embodiment, the lid 170 is constructed with a larger x and y dimension than an unfilled container so that when the container 100 is filled, the sides of the container expand to meet the lip portion 172 of the lid. The lid 170 may secure to the container by attachments means 174, such as Velcro. The lid 170 may also be attached (not shown) to the wall panels 102 of the container. For example, the lid 170 can be constructed from two lid flaps that are connected to the top of two opposing wall panels 102. The lid flaps fold over to close the container and the lid flap may include rigid panels within them to provide structural support for stacking.

Optionally, bin handles 180 or loops are sewn to the container so that they align with webbing straps on the rim of the lid. The bin handles 180 allow the container to be lifted from the sides rather than from the bottom edges. The bin handles 180 can also be attached to webbing straps on the rim of the lid to secure the lid to the container. The bin handles can be attached by sewing or welding to the vertical seams or to the outside layer of the walls. In some embodiments, two to four loops made from webbing are sewn into the vertical seams so that the container can be picked up for stacking or to allow discharge of contents. In other embodiments, handles for picking up the empty container when erected or collapsed can be located anywhere on the container. The handles can be sewn or welded onto the material comprising the container.

FIGS. 3 and 20 depict another embodiment wherein the container collapses by having V-fold wall panels 200 on opposite sides of the container. The V-fold wall panels 200 are constructed from two sheets of material sewn or welded together, as described herein. Two rigid panels are enclosed in the V-fold wall panels 200 and separated by a seam 202 running the length of the wall panel. In an embodiment, the V-fold design includes a device 204 that allows the two panels to fold in a single direction. The device 204, such as a tab, may be attached to the exterior wall on either side of the seam. The device 204 allows the panels to fold inward towards the center of the container but prevents the V-fold panels from folding outward. When the V-fold wall panels are extended as in FIG. 3, the rigid panels support the container in an upright position. When the V-fold walls are folded in, however, the container may be collapsed, as depicted in FIG. 20. In a collapsed formation, the V-fold wall panels 200 are angled inward and positioned between the front wall 152 and the back wall 154.

In some embodiments, the containers include document pockets 190 or placards on the container, as depicted in FIG. 15. The document pockets 190 are sewn or welded onto the container for placing removable material, such as identifying labels, on container. The document pockets 190 can be polyethylene sealable bags or they can be a single sheet attached to the container walls on three sides so that labels can be placed in the pocket created between the sheet and the wall.

Turning to FIG. 21, a method of constructing a collapsible container is provided, in accordance with an embodiment of the invention. In an embodiment, the method is for manufacturing a generally square or rectangular octagonal-shaped collapsible container (e.g., a bulk bag (FIBC)). An octagonal-shaped collapsible container is a bulk bag comprising eight sections. For example, the bulk bag may be generally square or rectangular in shape but include stiffening panels in walls such that eight distinct panels define the exterior of the container. In order to manufacture a generally square or rectangular bulk bag comprising eight sections, the angles created between the sections will not be equal. For example, the substantially square bulk bag or collapsible container may have four acute angles that are approximately a 90 degree angles (e.g., within 3 degrees) and four obtuse angles that are approximately 180 degree angles (e.g., within 3 degrees). In an embodiment, the sections of the octagonal-shaped collapsible container are equal in length.

In an embodiment of manufacturing the collapsible container, the four side wall assemblies 250 each comprise an inner layer and an outer layer of woven fabric, film, or vinyl. Two wall portions are secured together vertically by single, double chain, or lock stitching in two sew line locations 252 to create a double layer wall section. In an embodiment, the stitching is located equally distant from each vertical fabric edge of the two double wall portions. These two vertical sew lines will create corner pockets when four wall assemblies are sewn together. In another embodiment, a single layer of material can be folded in half to create a double layer wall section. In this embodiment, a vertical stitch is used to create corner pockets on either side of the vertical stitch. In a further embodiment, four webbing lift loops 256 can be sewn to the container, for example one at each vertical seam. The lift loops can be sewn between the layers of fabric or to the inner or outer layer of fabric for assisting in lifting the bag with the stiffening panels inserted when filled.

After constructing four wall sections 250, two of which have a vertical stitch 252 bisecting the panel and two of which do not, the four wall sections are sewn together end to end and create four connected walls with a total of eight receiving pockets for receiving stiffening panels. For an equal-sided octagonally-shaped collapsible container, all eights pockets are equal in width and height. For an elongated octagon, square or rectangular designs, four of the eight pockets alternating every other pocket are smaller in width and define the four corner pockets. These four corner pockets are approximately 45 degree angles to the two pockets that they are located in between when stiffening panels are inserted into all eight pockets. For a generally square octagonally-shaped collapsible container, the four center wall pockets are equal in width and height and the four corners are equal in width and height. The corner and center wall pockets have different widths and the same height. For a generally rectangular octagonally-shaped collapsible container, the two opposite center walls are the same width and height and the remaining two center walls are larger in width but equal in height to the adjacent center wall pockets. For all designs, in some embodiments there is no bottom wall or later of fabric sewn to the bottom of the four walls. Instead, the bottom of the collapsible container may be left open like a sleeve.

In an embodiment, a third layer of fabric is sewn into the four vertical seams on the inside of the double layer wall sections when the wall sections are being sewn together. The third layer can either be sewn together as a four panel or U panel flexible intermediate bulk container consisting of four sides, a bottom, and a bottom discharge spout with a protective cover forming a bulk bag inside the four walls. The third layer of fabric is positioned and sewn into the vertical seams of the wall assemblies so that the bottom of the third layer is suspended in the air above the bottom of the four wall sections after stiffening panels have been inserted.

In a further embodiment, at least one horizontally disposed reinforcement band 254 extending around the periphery of the four side walls and secured by sewing into the four vertical seams and into the four vertical sew lines that form the four corner pockets. On the two walls without vertical sew seams, the band is secured by box stitching to the outside layer of fabric on the center of each wall. Bands can be sewn at different heights horizontally around the four walls.

In a further embodiment shown in FIG. 23, a double layer top panel 258 for covering the upper end of the collapsible container can be provided. The double layer top panel can be configured for receiving a stiffening panel. In an embodiment, the top panel is larger in length and width than the top of the empty collapsible container with stiffening panels inserted. This allows the top panel to cover the collapsible container when the collapsible container is filled with content and the sides bulge outwards. For an equal-sided octagonally-shaped container, the double layers of the top panel are cut in an equal-sided octagonal array pattern and the double layer is slightly larger in diameter than the top of the equal-sided collapsible container. For an elongated generally square collapsible container, the double layers for the top panel are cut in a generally rectangular octagonal array pattern with four equal sized corners and four equal sized sides alternating corner then side. The top panel is slightly larger in diameter than the top of the container and the corner sides are to be at approximately 45 degree angles to the center wall sides. For an elongated generally rectangular collapsible container, the double layers for the top panel are cut in a rectangular octagonal array pattern with four equal sized corners and the two opposite side walls being the same length. The two remaining sides are larger in length. The top panel is also slightly larger in size than the collapsible container and the corner sides are at approximately 45 degree angles to the center wall sides. In an embodiment, all double layer top wall panel designs have a fabric rim 260 sewn to both layers around the entire periphery of the top panel.

In a further embodiment, a strap 262 made from webbing may be sewn to the rim to secure the double layer top to the container. The strap may be secured to the top panel at the four corners. The strap may further attach to the container at the reinforcement bands 254 sewn around the periphery of the bag. In an embodiment, the straps have grommets or other attachment devices that align with one another and can be secured closed to make the top tamper evident when secured to the bag.

In FIG. 22, another method of constructing a collapsible container is provided, in accordance with a further embodiment of the invention. In an embodiment, the method includes assembling four side wall assemblies, two 264 comprising an inner and outer layer of woven fabric, film or vinyl. The other two walls 266 are made from single layer of woven fabric, film or vinyl. The double layer wall sections can be made by sewing double layers together or by folding a single layer of material in half to create two double layer wall sections. The double layer wall section 264 can include a vertical sew line 268 defining pockets on either side of the sewn line.

The four wall sections are then sewn together vertically on all eight vertical sides of the four walls assemblies creating four vertical seams. Woven fabric, film or vinyl is used to create two separate pockets that are sewn into two consecutive vertical seams on the inside of bag. The swing wall pockets are configured to receive stiffening panels to be inserted into each pocket. These pockets swing open and closed with the stiffening panel inserted for set up and collapsing of the container.

On the outside of each swing wall is a an attachment strip, such as Velcro or other adhesive, sewn horizontally located at the top of the wall that aligns with opposite Velcro sewn on the inside of the single layer walls to secure to the swing wall Velcro to hold swing wall open.

The two double wall portions sewn together with swing wall pockets have created four connected walls with a total of four receiving pockets for stiffening panels.

Instead of swing wall pockets on the two opposite sides, all four walls can be constructed from double layers of fabric and two opposite sides can have a vertical sew line creating two equal sized pockets per wall on two opposite sides of the bag. The bag with stiffening panels can be collapsed by pushing the center of the two opposite sides with vertical center sew line inwards.

For the rectangular design the two opposite length walls are constructed from a double layer of fabric, film or vinyl, creating pocket for receiving stiffening panel. The remaining two walls are smaller in width but equal in height to the adjacent wall pockets.

In an embodiment, there is no bottom wall or layer of fabric sewn to the bottom of the four walls. Instead, the bottom of the container is left open like a sleeve.

In an embodiment, a third layer of fabric is sewn into the four vertical seams on the inside of the double layer wall sections when the walls sections are being sewn together. The third layer can either be sewn together as a four panel or U panel flexible intermediate bulk container including fours sides, a bottom and a bottom discharge spout with a protective cover forming a bulk bag inside the four walls. In an embodiment, the third layer of fabric is positioned and sewn into the vertical seams of the wall assemblies so that the bottom of the third layer (inner bag) is suspended in the air above the bottom of the four wall sections after stiffening panels have been inserted.

It should be understood that the top layer, the compression straps, the attachment straps, and the lift loops previously described may also be incorporated into the method of manufacturing the collapsible containers.

In another aspect of the invention, a method for discharging content from collapsible containers is provided. In an embodiment, the method includes providing containers as described herein, loading content into the containers in the free-standing position, raising the containers, undoing a sealing mechanism in an internal liner, allowing the content to automatically and completely discharge from the container, and then collapsing the containers for easy transport. The containers can be stored and transported in a stacked position and because of the hexagonal or rectangular shape of the containers, storage spaces can be used efficiently with the containers. Collapsing the containers occurs as described herein and allows the containers to be reduced to a fraction of their size. The method provides several advantages over the previously known methods including that the containers automatically, safely, and completely discharge content, the containers are lightweight and reusable, that the containers are strong enough to be stacked up to eight high with heavy loads yet can be folded down when not needed, and that the method allows manufacturers to save money and time by having an efficient use of space when shipping the containers loaded and when shipping the empty containers.

Although the invention has been variously disclosed herein with reference to illustrative embodiments and features, it will be appreciated that the embodiments and features described hereinabove are not intended to limit the invention, and that other variations, modifications and other embodiments will suggest themselves to those of ordinary skill in the art, based on the disclosure herein. The invention therefore is to be broadly construed, as encompassing all such variations, modifications and alternative embodiments within the spirit and scope of the claims hereafter set forth.

I claim:

1. A collapsible container, the container comprising:

a collapsible sleeve having a first end and a second end; and a liner attached to the collapsible sleeve at the first end, wherein the liner comprises an apex and is suspended within the collapsible sleeve, wherein the liner is sized so that the apex is suspended in the collapsible sleeve above a surface upon which the second end of the collapsible sleeve is resting.

2. The collapsible container of claim 1, wherein the apex includes an opening configured for discharging content from the collapsible container.

3. The collapsible container of claim 1, wherein the first end and the second end are open.

4. The collapsible container of claim 1, wherein a cylinder extends from the apex to a position on the opposite side of the second end.

5. The collapsible container of claim 1, wherein a sealing mechanism closes the apex.

6. The collapsible container of claim 5, wherein the sealing mechanism is selected from the group consisting of rope, twist ties, Velcro, cable ties, and clips.

7. The collapsible container of claim 1, further comprising a rigid lid attached at the first end of the sleeve and configured to support the weight of a second container.

8. The collapsible container of claim 1, wherein the collapsible sleeve comprises receiving pockets configured for receiving stiffening panels.

9. The collapsible container of claim 8, wherein the receiving pockets are defined by vertical seams.

10. The collapsible container of claim 8, wherein the collapsible sleeve is octagonal and comprises eight receiving pockets configured for receiving eight stiffening panels.

11. The collapsible container of claim 1, further comprising at least one horizontal reinforcement band positioned on the inside or the outside of the collapsible sleeve.

12. The collapsible container of claim 1, further comprising lift loops attached to the collapsible container and configured for lifting the collapsible container when contents are loaded into the liner.

13. The collapsible container of claim 1, wherein the collapsible sleeve is resting on a pallet.

14. The collapsible container of claim 1, wherein the liner is permanently or removably attached to the collapsible sleeve.

15. A method for storing content in a collapsible container, the method comprising:

providing a container, as provided in claim 1;

loading content into the container when the container is in a free-standing configuration and the apex is closed.

16. The method of claim 15, further comprising releasing a sealing mechanism at the apex to open the liner and discharge the content.

17. A method for manufacturing a collapsible container, the method comprising:

(a) producing a collapsible sleeve having a first end and a second end, said method comprising:

(i) providing four side wall assemblies each comprising an inner layer and an outer layer of fabric, film or vinyl;

(ii) securing the inner layer and an outer layer of two of the side wall assemblies together using two vertical sew lines to create a pocket in each;

(iii) securing the four side wall assemblies together end to end, alternating the side wall assemblies with the two vertical sew lines and the side wall assemblies without the two vertical sew lines to create the collapsible sleeve having eight pockets; and (iv) inserting stiffening panels in the pockets, and (b) providing a liner attached to the collapsible sleeve at the first end, wherein the liner comprises an apex and is suspended within the collapsible sleeve, wherein the liner is sized so that the apex is suspended in the collapsible sleeve above a surface upon which the second end of the collapsible sleeve is resting.

18. A method for manufacturing a collapsible container, the method comprising:

(a) producing a collapsible sleeve having a first end and a second end, said method comprising:

(i) providing four side wall assemblies, wherein two of the four side wall assemblies are a single layer of fabric, film, or vinyl and two of the four side wall assemblies are a double layer of fabric, film, or vinyl;

(ii) securing the four side wall assemblies together end to end, alternating the side wall assemblies with a single layer and the side wall assemblies with a double layer to create the collapsible sleeve;

(iii) providing a vertical sew line in each of the double layer wall assemblies, the vertical sew lines defining two pockets in each of the double layer wall assemblies; and (iv) inserting stiffening panels in the pockets; and (b) providing a liner attached to the collapsible sleeve at the first end, wherein the liner comprises an apex and is suspended within the collapsible sleeve, wherein the liner is sized so that the apex is suspended in the collapsible sleeve above a surface upon which the second end of the collapsible sleeve is resting.

* * * * *